US010524596B2

(12) United States Patent
Pesale et al.

(10) Patent No.: US 10,524,596 B2
(45) Date of Patent: Jan. 7, 2020

(54) MULTIPLE POD PILLOW SYSTEM

(71) Applicants: Catherine M. Pesale, Stratford, CT (US); Robert Pesale, Stratford, CT (US)

(72) Inventors: Catherine M. Pesale, Stratford, CT (US); Robert Pesale, Stratford, CT (US)

( * ) Notice: Subject to any disclaimer, the term of this patent is extended or adjusted under 35 U.S.C. 154(b) by 341 days.

(21) Appl. No.: 15/165,729

(22) Filed: May 26, 2016

(65) Prior Publication Data

US 2016/0345760 A1 Dec. 1, 2016

Related U.S. Application Data

(60) Provisional application No. 62/167,130, filed on May 27, 2015.

(51) Int. Cl.
*A47G 9/10* (2006.01)

(52) U.S. Cl.
CPC ..... *A47G 9/109* (2013.01)

(58) Field of Classification Search
CPC ..... A47G 9/10
USPC ..... 5/636, 632, 640
See application file for complete search history.

(56) References Cited

U.S. PATENT DOCUMENTS

D262,817 S 1/1982 Griffith
D263,066 S 2/1982 Merino et al.
5,437,070 A * 8/1995 Rempp ..... A47G 9/10 5/636
D413,751 S 9/1999 Alyea
D418,711 S 1/2000 Mettler
6,499,165 B1 12/2002 Morgillo
D481,247 S 10/2003 Roberts et al.
6,859,964 B1 * 3/2005 Arnott ..... A47C 20/00 5/636
7,010,821 B1 3/2006 Leach
7,082,633 B1 8/2006 Maarbjerg
D554,221 S 10/2007 Peterson
7,373,678 B2 5/2008 Hetzel
7,676,871 B1 3/2010 Leach
D624,346 S 9/2010 Salzman
D638,083 S 5/2011 Barbis
D648,586 S 11/2011 Yu
D704,963 S 5/2014 McNeil
D722,449 S 2/2015 Krishtul
D749,874 S 2/2016 Ueno
D752,901 S 4/2016 Ueno
(Continued)

*Primary Examiner* — Frederick C Conley
(74) *Attorney, Agent, or Firm* — Ware, Fressola, Maguire & Barber LLP

(57) ABSTRACT

The multiple pod pillow system according to the present invention may be configured as a headpiece multiple pod pillow system a central pod, a first pod, and a second pod. Each of the pods may be independent and self-contained relative to the other pods. The multiple pod pillow system may also include hand straps or attachment fixtures that allow for the optional connection of one or more additional extension pods. The aforementioned hand straps and the aforementioned attachment fixtures may attach to the one or more additional extension pods. The one or more individual pods of the multiple pod pillow system may be configured, alone or in combination, to support the weight of the head and keep the neck at a height that will keep it in line with the spine when the user is sleeping on user's back or side.

8 Claims, 15 Drawing Sheets

(56) References Cited

U.S. PATENT DOCUMENTS

| | | | |
|---|---|---|---|
| D761,595 | S | 7/2016 | Pulver |
| D796,869 | S | 9/2017 | Higashi |
| D800,395 | S | 10/2017 | Olley |
| 2005/0022305 | A1 | 2/2005 | Bieganek |
| 2007/0151031 | A1 | 7/2007 | Leach |
| 2008/0052832 | A1 | 3/2008 | Racovolis |
| 2010/0175192 | A1 | 7/2010 | Aiken |
| 2010/0175194 | A1 | 7/2010 | Mastrosimone-Gese |
| 2010/0205744 | A1 | 8/2010 | Edwards |
| 2012/0240339 | A1 | 9/2012 | Fair |
| 2013/0198961 | A1 | 8/2013 | Davis |

* cited by examiner

MULTIPLE POD PILLOW SYSTEM

CROSS-REFERENCE TO RELATED APPLICATIONS

This application claims priority to U.S. Provisional Appl. No. 62/167,130 filed May 27, 2015, which is incorporated by reference herein in its entirety.

BACKGROUND OF THE INVENTION

1. Field of the Invention

The present invention relates to a multiple pod pillow system, and more particularly to a multiple pod pillow system that allows a user to sleep comfortably on the user's back or side while keeping the user's head in the desired neutral plane without creating unwanted forward flexion, extension and lateral bending of the head as compared to the thoracic spine.

2. Description of Related Art

Conventional pillows used for sleeping, reclining and/or resting are well known. Conventional pillows suffer from several drawbacks that are also well known, and a variety of different pillow options have been proposed attempting to address the drawbacks of conventional pillows. For example, U.S. Pat. No. 7,100,227 is directed to an anti-snoring pillow, but does not disperse the bulk in any way that prevents the hyperextension of a user's neck. Similarly U.S. Pat. No. 4,393,530 is directed to a pillow, but it does not adequately address how the weight of a user's head can distort the pillow so as to also lead to unwanted forward flexion, extension and lateral bending.

Therefore, what is needed is a pillow system for sleeping that allows a user to sleep comfortably on the user's back or side while keeping the user's head in the desired neutral plane without creating unwanted forward flexion, extension and lateral bending of the head as it compares to the thoracic spine.

SUMMARY OF THE INVENTION

The present invention is designed to overcome the above noted limitations that are attendant upon the use of conventional pillows and, toward this end, it contemplates the provision of a novel multiple pod pillow system.

It is an object of the present invention to provide a multiple pod pillow system that is comprised of one or more individual pods positioned and attached strategically together to create a pillow for sleeping. Each of the pods may preferably be a self-contained, attachable or otherwise affixable polygonal cushion containing a fill material.

It is another object of the present invention that the one or more individual pods and/or the multiple pod pillow system may be comprised of structural fabrics that ensure user comfort.

It is still another object of the present invention that the multiple pod pillow system and/or the one or more individual pods of the multiple pod pillow system are filled with fiberfill, or similar material, that will reduce and/or prevent the likelihood that each individual pod is substantially flattened under the weight of a user's head and/or body.

It is yet another object of the present invention that the multiple pod pillow system helps a user to avoid neck injury and ensures proper neck posture for the user while sleeping.

It is yet another object of the present invention that the individual pods are attached together in a way that the weight of the user's head and the way the multiple pod pillow system aligns with the user's neck help with the distribution of the pods while in use by the user.

It is still another object of the invention that each individual pod of the multiple pod pillow system has an appropriate amount of filling material in it to strategically maintain a firm yet not too bulky appearance and the ability to be functional and comfortable for the user.

It is still another object of the invention that the fabric comprising each individual pod's outer layer is made out of hypoallergenic, moisture-controlling fabrics. This type of fabric preferably maintains structure yet is not so rigid that it is uncomfortable for the user. It is understood that different individual pods within the multiple pod pillow system can be made of additional fabrics for added comfort.

It is still another object of the present invention that each individual pod may contain a natural or synthetic filling material, and each individual pod may also be self-contained from the other individual pods so that preferably the filling material for each individual pod is kept separate.

It is yet another object of the present invention that the multiple pod pillow system of the present invention may include individual pods contained within other individual pods, so that the filling material of the individual pods within another individual pod is self-contained and will not disperse to fill to the other sides. In accordance with this object of the present invention the multiple pod pillow system has reduction and/or resistance from flattening or bulking up underneath the user's head during sleep or from continued use.

It is still another object of the present invention that the multiple pod pillow system is designed to cradle the user's neck in a position neutral to the spine in a way that is comfortable and supportive while also preventing hyperextension, hyperflexion and extensive lateral bending.

It is yet another object of the present invention that the individual pods can be attached to each other in such a way so that the system responds to the weight of the user's head and the way the user tucks the curved, bottom pod into the user's neck in such a way as to help distribute the pods so that the pods cradle the user's neck in a comfortable and supportive manner, while also preventing hyperextension, hyperflexion and extensive lateral bending.

It is still another object of the present invention that the multiple pod pillow system may include hand straps on one or both sides of the multiple pod pillow system to accommodate users who prefer to hold onto pillows or other objects during sleep or otherwise secure their hands during sleep.

It is still another object of the present invention that the multiple pod pillow system may include attachment fixtures that enable the attachment of additional extension pods.

It is another object of the present invention that the multiple pod pillow system may include a form fitting cover that is made in a way to be able to remove and put on easily to allow for protection for the multiple pod pillow system and be washable.

It is still another object of the present invention that the aforementioned form fitting cover may contain cushion-like material to prevent ear pain and other facial pain during sleep.

It is yet another object of the present invention that the form fitting cover fits the multiple pod pillow system using elastic and has an opening in the back to easily take on and off, with attachment devices to secure and keep the cover in place.

It is still another object of the present invention that the form fitting cover does not obstruct or substantially alter the shape of the multiple pod pillow system, which would allow the user to use the shape of the multiple pod pillow system without obstruction.

Accordingly, an exemplary embodiment of the multiple pod pillow system according to the present invention may include three individual external pods: a base pod, a left from center top pod and a right from center top pod. The pods are strategically attached together, for example by sewing, to create the multiple pod pillow system.

According to another exemplary embodiment of the multiple pod pillow system according to the present invention may be configured as a headpiece multiple pod pillow system comprising a left from center top pod, a right from center top pod, a central encased pod, and/or hand straps or attachment fixtures that allow for the optional connection of one or more additional extension pods. The aforementioned hand straps and the aforementioned attachment fixtures may attach to the one or more additional extension pods.

The multiple pod pillow system may also be configured as a headpiece multiple pod pillow system comprising a left of center pod and a right of center pod that are each permanently affixed on the underside to a base pod having arm extensions.

The one or more individual pods of the multiple pod pillow system may be configured, alone or in combination, to support the weight of the head and keep the neck at a height that will keep it in line with the spine when the user is sleeping on user's back or side.

The base pod of the exemplary embodiments of the multiple pod pillow system may be curved in a way on the bottom, neck side where there are two arms on either side of center that are shaped so that the side sleeper can grab onto the arm on either side of the system and rest the arm in a way as to not compromise the way the head is positioned in the center of the system. Providing the option for either an attachable or built-in arm extension to hold onto would also help ensure the user's spine is in a neutral position on his or her side to keep the spine in a neutral position.

The base pod may be shaped at the top as well to accommodate the shape of the user's head in the center, yet curve from the top down to the arm in a way that allows the top pods on either side to distribute their bulk away from the base and onto the surface that the pillow is being used on.

The weight of the user's head and the way the user tucks the pillow under their neck all helps to distribute the bulk of the top pods towards the back of the bottom pod and away from the bulk of the bottom pod as to not hyperextend the user's neck and allows the neck to be neutral and maintain optimal spinal alignment.

In certain exemplary embodiments of multiple pod pillow system, the curve of the base pod is made in a way that still allows the back sleeper to lie comfortably without the bulk of the arms on either side of the base pod getting in their way.

In certain exemplary embodiments of the multiple pod pillow system according to the present invention, in addition to the filling material being in the separate individual external pods, inside the base pod, there may be an internal pod.

In certain exemplary embodiments of the multiple pod pillow system, the height of the base individual pod may be made to accommodate the length of the average person's neck so that the base individual pod keeps the head neutral to the spine. This height can be different for small and larger users, and therefore the height and width of the multiple pod pillow system can be adjusted based on the size of the user.

In certain exemplary embodiments of the multiple pod pillow system, the multiple pod pillow system can be constructed in different sizes to accommodate a smaller neck size and a larger one.

In certain exemplary embodiments of the multiple pod pillow system, the top two individual pods may be centered to the left and right of a mid-line. The left top pod angles in thickness from the left and gets thinner going towards the mid-line. The right top pod angles in thickness from the right and gets thinner going towards the mid-line. The two left and right top pods are attached onto a bottom individual pod where the thinner portion is lined up on the bottom center and is attached in a way that connects them all together yet still maintains the separate individual pods. The centerline where the two top pods are attached together creates a dip in the top of the multiple pod pillow system where the head of a user naturally falls into. This dip is created by the position of the pods and not a depression in any of the particular individual pods. The dip is subtle for the user, yet creates enough of an effect to allow the ear to rest comfortably without the pressure of being flat on the pillow while the user is on their side.

The weight of the user's head flattens out the left and right center pods so that the center dip is subtle, yet pertinent enough to maintain a neutral position. The curve of the bottom pod at the back top of the system allows for the bulk of each side pod to be dispersed also. This acts as a cradle or cup like bowl for the head to rest in.

Along with the weight of the head and the placement of the top two pods, the bulk of the left and right top pods get distributed towards the back of the pillow creating a natural cradle of the head to further the ability to stabilize the sleeper's neutral position to the spine. This cradling also supports the neck without having to have the bulkiness of a neck roll or raised compartment in the base pod.

The subtle dip in the middle keeps the head from hyperextending while sleeping on their side on the pillow, keeping the neck in a neutral position. While the user is on their back, the neck is in a neutral position and does not hyperextend from side to side.

In certain exemplary embodiments of the multiple pod pillow system according to the present invention, sewn into the back of the base is a grosgrain tab which has two snaps installed. The tab also acts as the product label. The snaps are used in conjunction with the snaps on the form fitting pillow cover to secure the cover from slipping off the back of the pillow while the user is sleeping on it.

In certain exemplary embodiments of the multiple pod pillow system according to the present invention, a separate, yet encasing, form fitting cover may be provided that is made in a way that it slips over the two front arms in the base pod and snuggly fits over the top pods using elastic to gather the fabric underneath the two top pods in order for the user to put their hands up the arm of the system and under the top pods without obstructing the shape and form of the pillow system. The cover is pulled up and over the two top pods and the top and bottom of the cover snaps into the tab that is located on the grosgrain tab sewn into the multiple pod pillow system. The cover is made from cotton, polyester blend or bamboo fabrics that are machine washable.

The multiple pod pillow system for sleeping has been approved and used by a doctor of chiropractic.

According to an exemplary embodiment of the present invention a pod pillow system is provided that may include a central pod, a first pod positioned adjacent to the central pod, and a second pod positioned adjacent to the central pod and connected to the first pod.

In accordance with this or other exemplary embodiments of the present invention, a curve may be formed from the connection between the first pod and the second pod, and the curve may be positioned on a side of the pod pillow system opposite the central pod.

In accordance with this or other exemplary embodiments of the present invention, the central pod, the first pod and the second pod may be configured for receipt of a fill material, and the fill material received within each of the central pod, first pod and second pod may be retained within the respective pod.

In accordance with this or other exemplary embodiments of the present invention, the first pod may be connected relative to the second pod to form a substantially V-shaped configuration on the side of the pod pillow system that is opposite the central pod.

In accordance with this or other exemplary embodiments of the present invention, the first pod may be connected relative to the second pod to form a substantially arcuate configuration on the side of the pod pillow system that is opposite the central pod.

In accordance with this or other exemplary embodiments of the present invention, the central pod, the first pod and the second pod may be connected so that their respective interior regions are independent of each other.

In accordance with this or other exemplary embodiments of the present invention, the pod pillow system may also include at least one extension pod removably affixed to pod pillow system.

In accordance with this or other exemplary embodiments of the present invention, one of the at least one extension pod may be removably affixed to the first pod by an attachment mechanism.

In accordance with this or other exemplary embodiments of the present invention, a cavity may be formed between the extension pod and the first pod.

In accordance with this or other exemplary embodiments of the present invention, the central pod may include one or more arm extensions.

In accordance with this or other exemplary embodiments of the present invention, the first pod and the second pod increase in size outward from the connection between the first pod and the second pod.

In accordance with this or other exemplary embodiments of the present invention, the first pod and the second pod may each be attached to the central pod at a central location of the pod pillow system.

According to an exemplary embodiment of the present invention, a multiple pod pillow system is provided that may include a combination of two or more pods, which may be self-contained, attachable or otherwise affixable polygonal cushions stuffed with fill material or similar material.

In accordance with this or other exemplary embodiments of the present invention, the two or more pods may be attached together or otherwise affixed from underneath on a curve flanked by two straight pieces, where the arc of the curve is capable of being manipulated to change the height of the system in order to accommodate different-sized head, necks and shoulder lengths.

In accordance with this or other exemplary embodiments of the present invention, the multiple pod pillow system contains side portions and construction that prevent the multiple pod pillow system from flattening out during use and allow it to spring back into shape after use, while also allowing it to sink down slightly and tilt back slightly during use without causing it to roll completely backwards.

In accordance with this or other exemplary embodiments of the present invention, the multiple pod pillow system incorporates strategically-placed darts on the underside of the pods that help create a well for the head to slightly drop into so that the user's head is cradled during use without causing it to be stuck in the center of the multiple pod pillow system.

In accordance with this or other exemplary embodiments of the present invention, the two or more pods are affixed to a separate individual pod that is constructed in such a way that the fill material or similar stuffing within it does not disperse during use, and that this separate pod is either sewn inside in a cavity or affixed to the center of the system with the other pods affixed around it.

In accordance with this or other exemplary embodiments of the present invention, either or all of the following are affixed to the systems, attachment fixtures that allow for the optional attachment of additional pod arms, affixed handles that the user can hold onto during use.

In accordance with this or other exemplary embodiments of the present invention, two or more pods are permanently affixed substantially midway on the surface of a separate base pod that is curved and features built-in arm extensions for the user to hold onto during use, the base pod is affixed to the other aforementioned pods in such a way so as to create a dip in the system that is configured to accommodate the user's head and which also causes the weight of the user's head to flatten out the pods affixed to the base pod and cradle the user's head.

In accordance with this or other exemplary embodiments of the present invention, an additional pod may be sewn or otherwise affixed within the base pod so that the fill or stuffing material in the inner pod does not disperse within the interior region of the curved pod to prevent disbursement of fill and prevent the base pod from flattening out through prolonged use.

In accordance with this or other exemplary embodiments of the present invention, the system may have a form-fitting cover than can be pulled up and over all pods used, including any attachable or built-in arm extensions, without obstructing the shape and form of the system.

In accordance with this or other exemplary embodiments of the present invention, the form-fitting cover may include an elastic or like material to gather the fabric underneath that makes the cover capable of fitting over each and every pod, including all and all arm extensions attached, attachment mechanisms that allow the cover to be pulled up and over the multiple pod pillow system, strategically-placed padding material that prevents ear pain during use and/or affixed or built-in handles that the user can hold onto during use.

BRIEF DESCRIPTION OF THE SEVERAL VIEWS OF THE DRAWINGS

For a fuller understanding of the nature and object of the present invention, reference should be had to the following detailed description taken in connection with the accompanying drawings, in which.

DETAILED DESCRIPTION OF THE INVENTION

Figure 1:
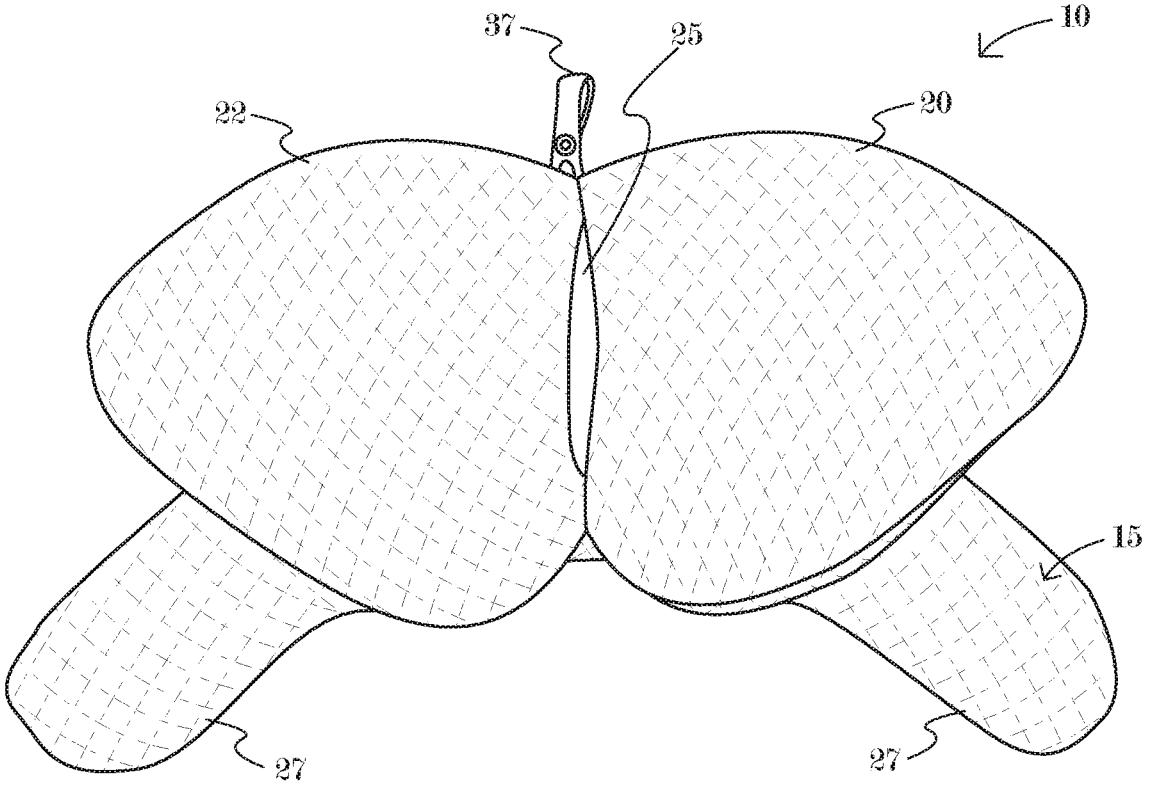
FIG. 1 is a top plan view of an exemplary embodiment of a multiple pod pillow system according to the present invention.
Figure 2:
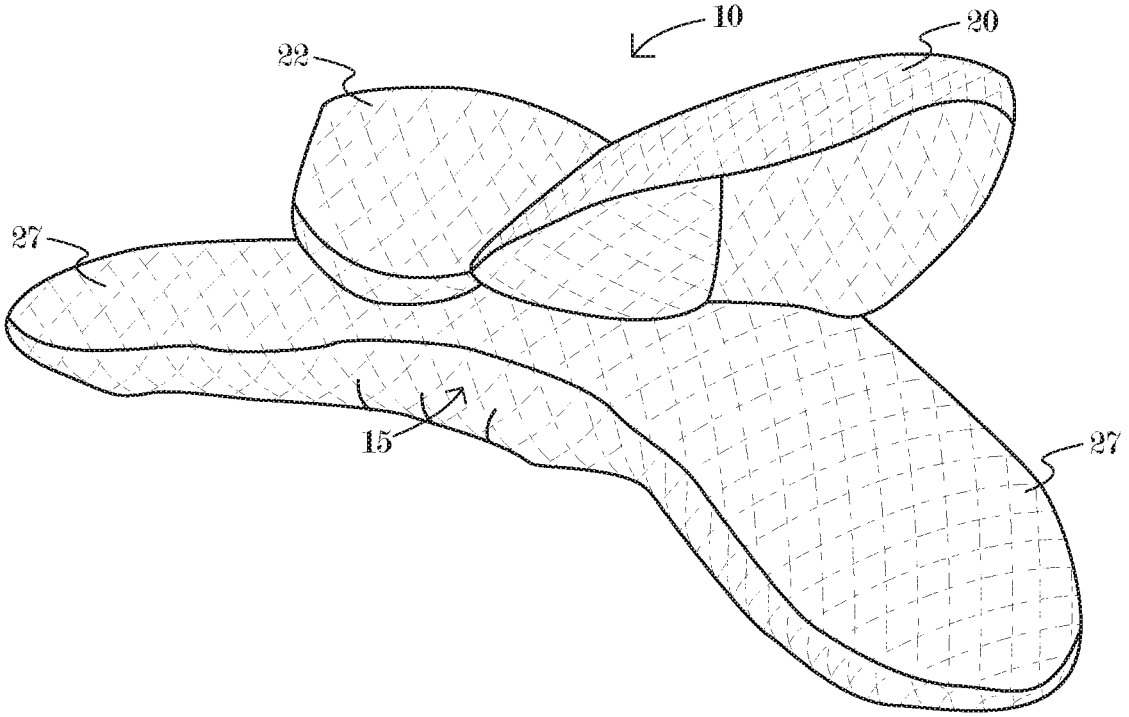
FIG. 2 is a side view of the exemplary embodiment of a multiple pod pillow system according to the present invention.
Figure 3:
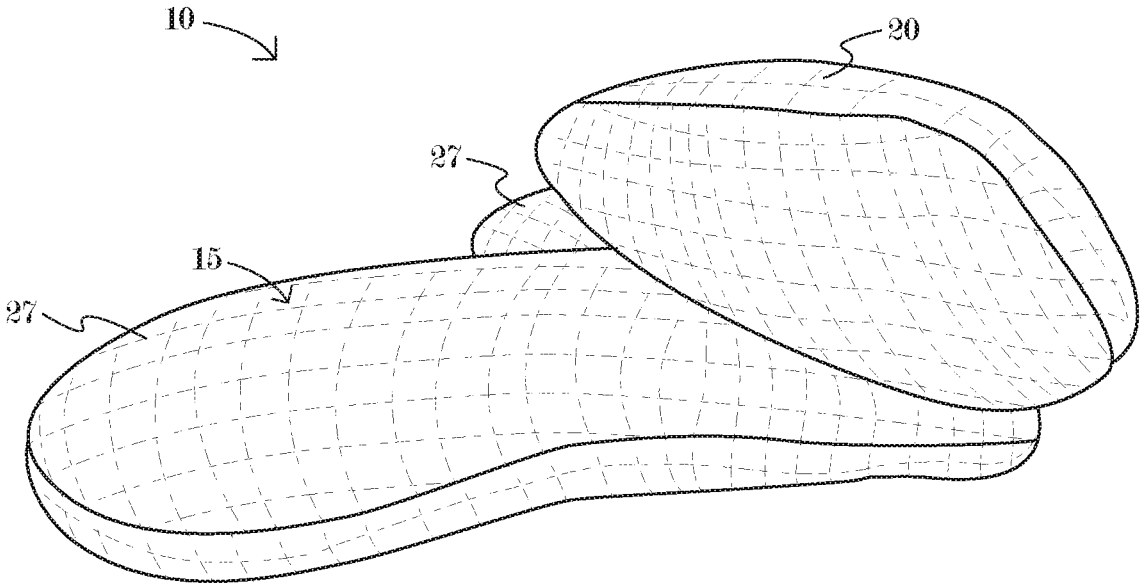
FIG. 3 is a side view of the exemplary embodiment of a multiple pod pillow system according to the present invention.
Figure 4:
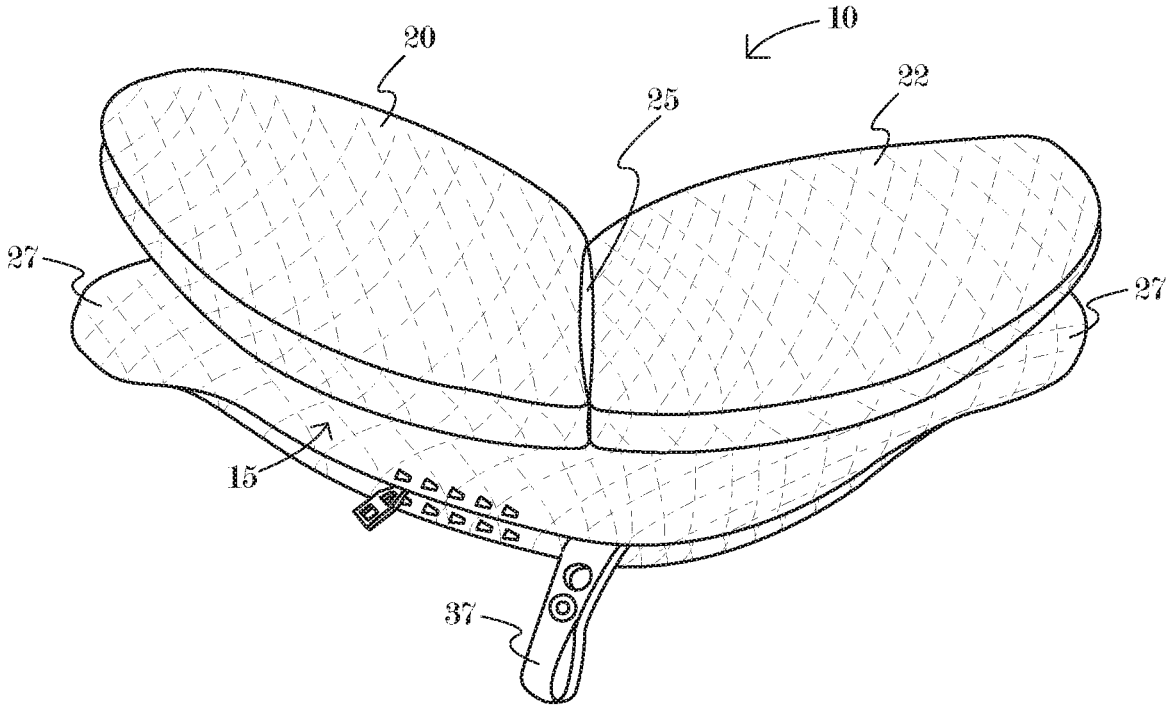
FIG. 4 is a back view of the exemplary embodiment of a multiple pod pillow system according to the present invention.
Figure 5:
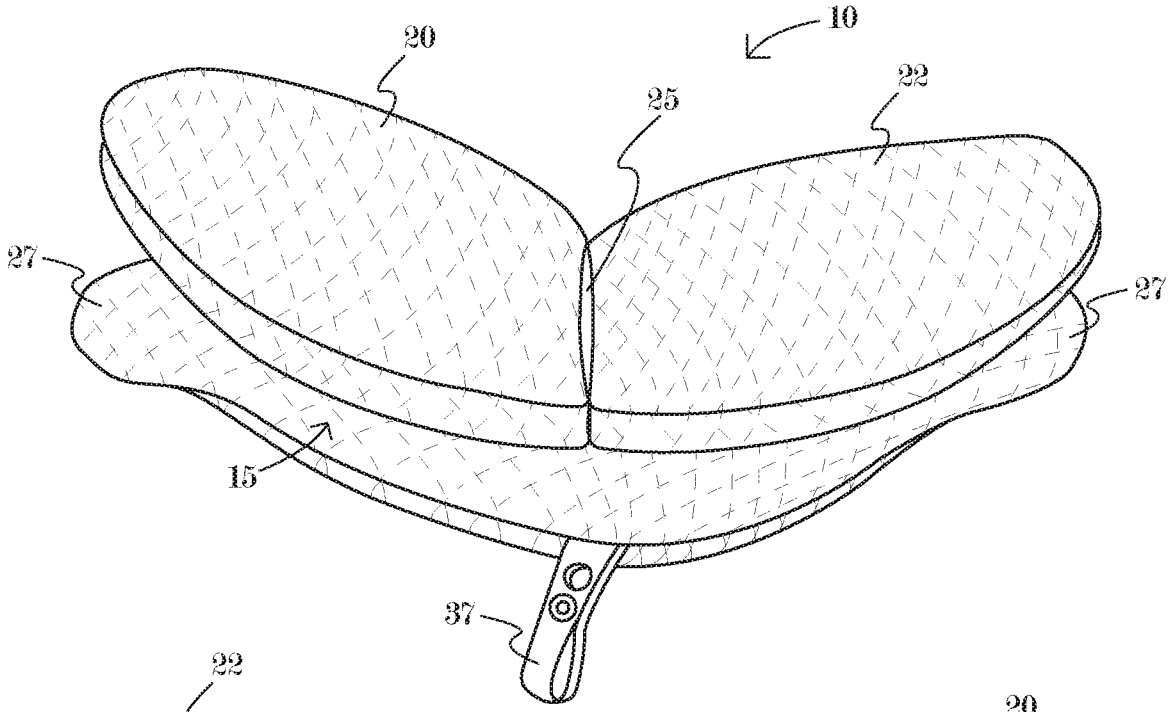
FIG. 5 is a back view of the exemplary embodiment of a multiple pod pillow system according to the present invention.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Referring now to FIGS. 1-6, therein illustrated is an exemplary embodiment of a multiple pod pillow system, generally indicated by reference numeral 10, according to the present invention. The pod pillow system 10 includes one or more individual pods, which may include a base pod 15, a left top pod 20 and a right top pod 22 that are affixed together to form the pod pillow system 10. It is understood that terms such as "base," "left," "top" and "right" are merely used for reference purposes only and are in no way limiting to the configuration and/or orientation of the present invention. The left top pod 20 and the right top pod 22 are affixed to the base pod 15 on either side of a center line of the base pod 15 that is positioned substantially midway between the ends of the base pod 15. The left top pod 20 and the right top pod 22 both increase in thickness as the distance from the center line of the base pod 15 increases. The left top pod 20 and the right top pod 22 may be affixed, such as by sewing, to the base pod 15 at substantially the thinnest portions of the pods 20, 22 in a manner that connects all of the pods 15, 20, 22 together, but still maintains separation of the pods 15, 20, 22. The configuration of the attachment of the left top pod 20 and right top pod 22 to the base pod 15 creates a dip 25 in the pod pillow system 10 that is configured to accommodate a head of a user of the pod pillow system 10. The dip 25 may further be configured to allow an ear of the user to rest comfortably without the pressure of being flat on the pod pillow system 10 while the user is on his/her side. The weight of the user's head flattens out the left top pod 20 and right top pod 22 so that the dip 25 may be subtle, yet prominent enough to maintain a neutral position of the user's head relative to the user's spine. The base pod 15 may have a curve at the back top of the pod pillow system 10 that allows for the bulk of the left top pod 20 and the right top pod 22 to be dispersed, which acts like a cradle or cup like bowl for the head of the user to rest in.

Still referring to FIGS. 1-6, the base pod 15 is configured to support the weight of the head of the user, and keep the neck at a height that will keep the neck in line with the spine when the user is sleeping on his or her back or side. The base pod 15 may be curved in a way on the bottom neck side, and may include a pair of arms 27 that are shaped so that if the user is sleeping on his/her side, the user can hold onto the arm 27 on either side of the pod pillow system 10, and rest the user's arm in a way as to not compromise the way the user's head is positioned at the center of the system. The base pod 15 may further be configured at its top portion so as to accommodate the shape of the user's head in the center, yet still be curved from the top down to the arms 27 so as to allow the left top pod 20 and right top pod 22 to distribute their bulk away from the base pod 15 and onto the surface on which the pod pillow system 10 is being used. However, preferably, the base pod 15 may be curved in such a manner to still allow the user, sleeping on his/her back, to lie comfortably without the bulk of the arms 27 interfering with the user's upper body.

Figure 6:
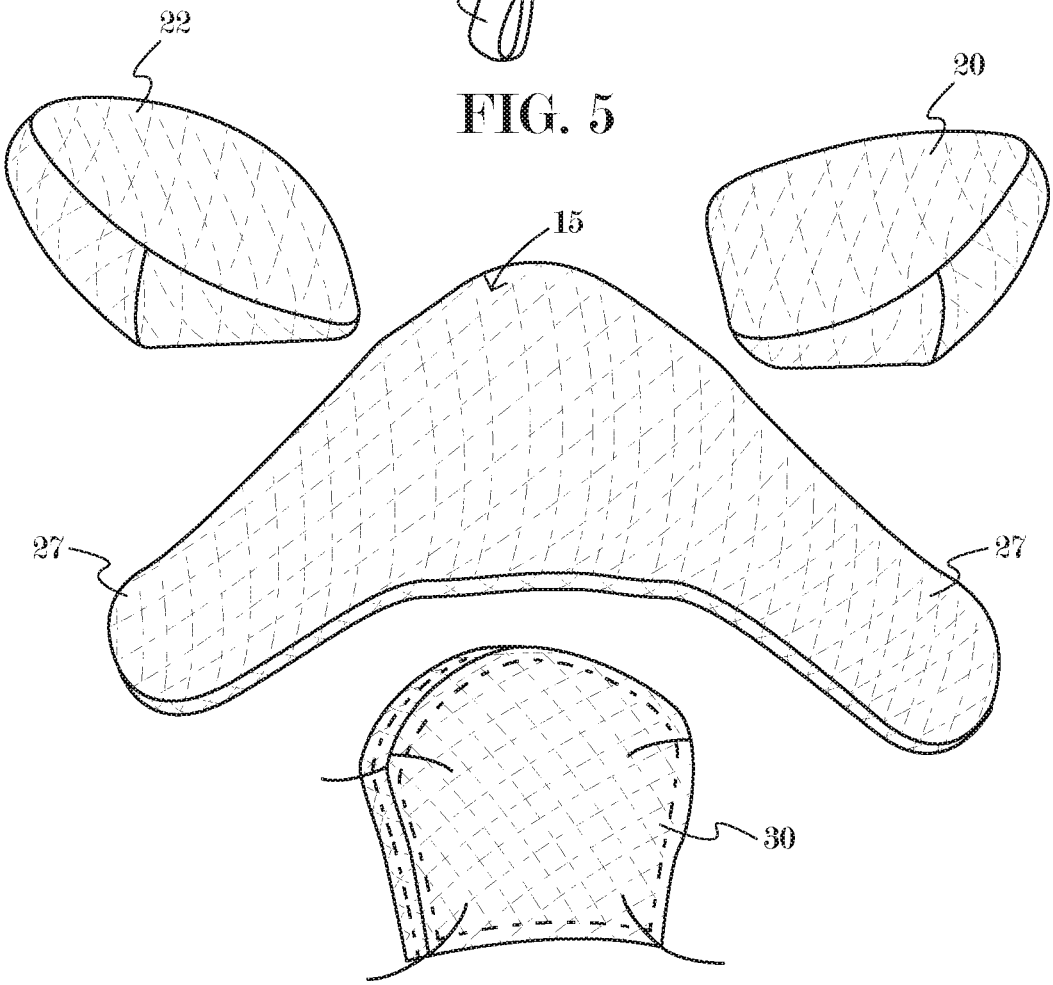
FIG. 6 is an exploded view of the exemplary embodiment of a multiple pod pillow system according to the present invention.
Figure 7:
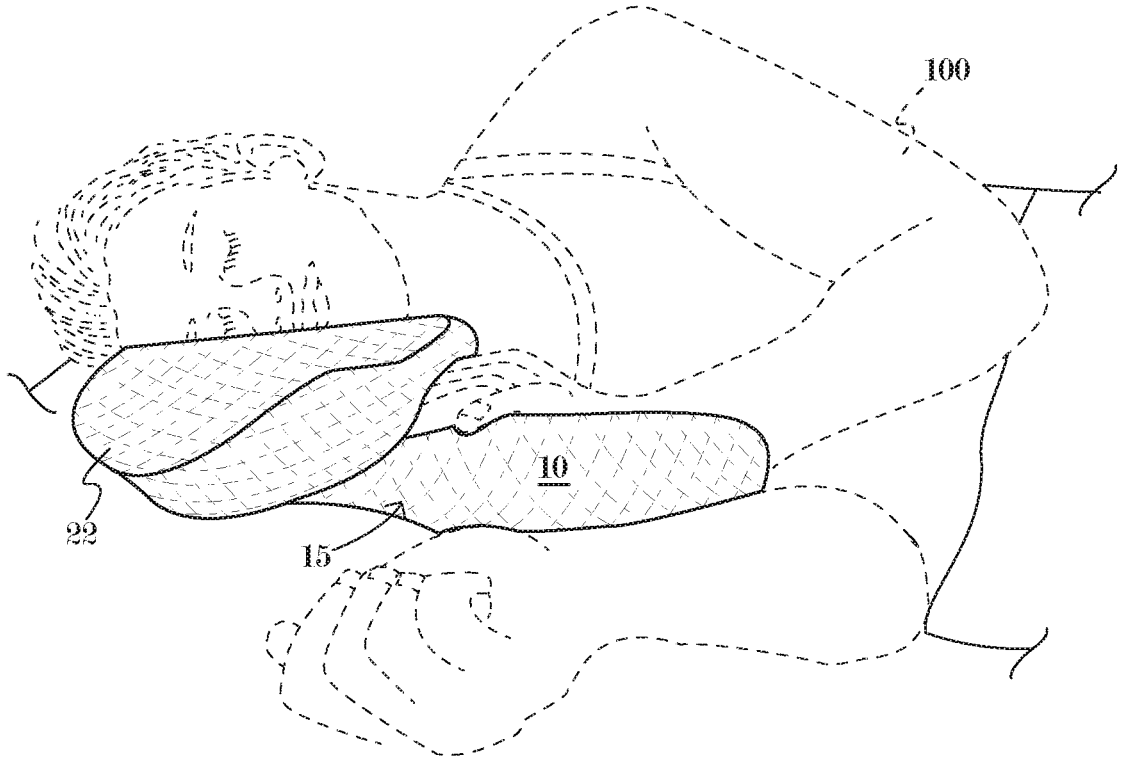
FIG. 7 is a side view of the exemplary embodiment of a multiple pod pillow system according to the present invention in use.
Figure 8:
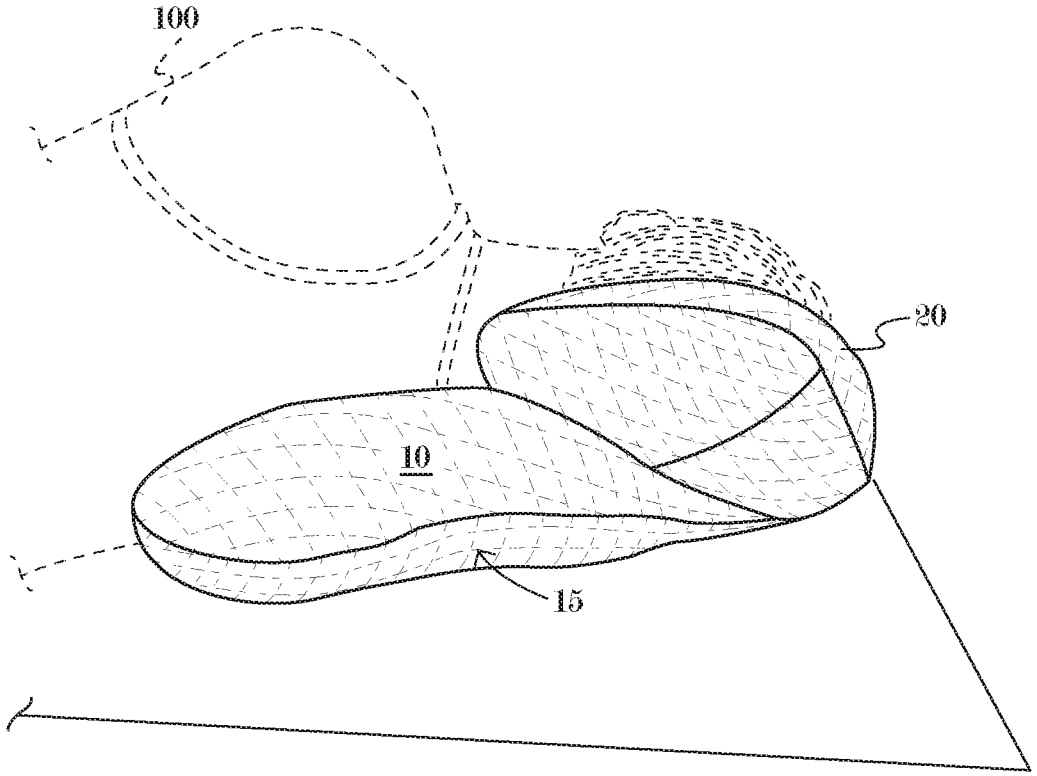
FIG. 8 is a side view of the exemplary embodiment of a multiple pod pillow system according to the present invention in use.
Figure 9:
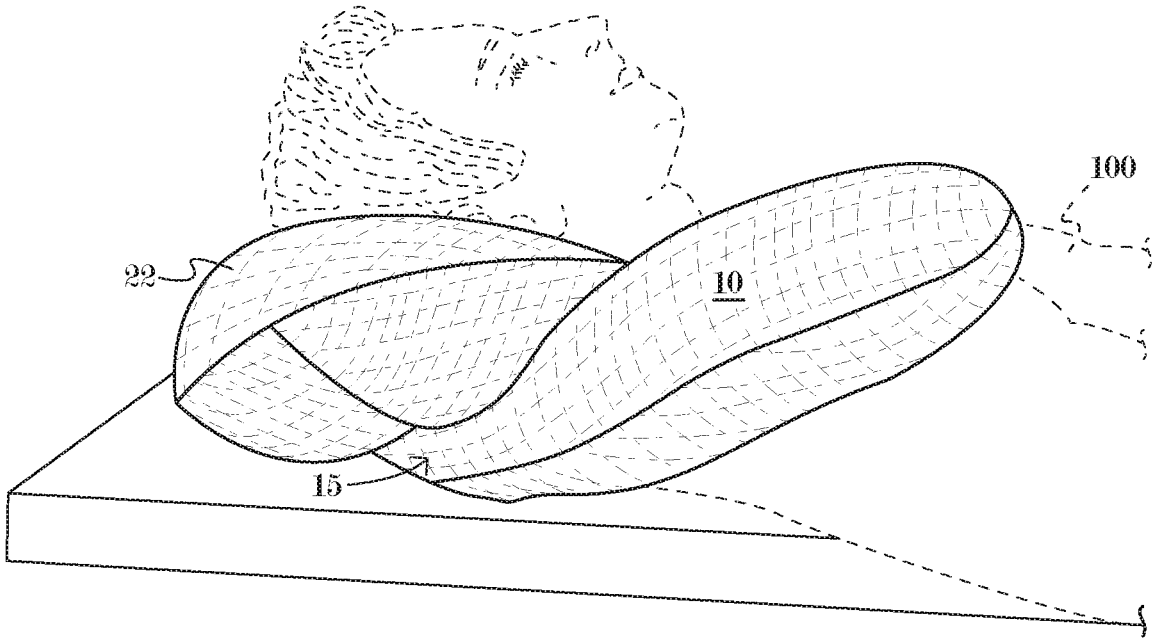
FIG. 9 is a side view of the exemplary embodiment of a multiple pod pillow system according to the present invention in use.
Figure 10:
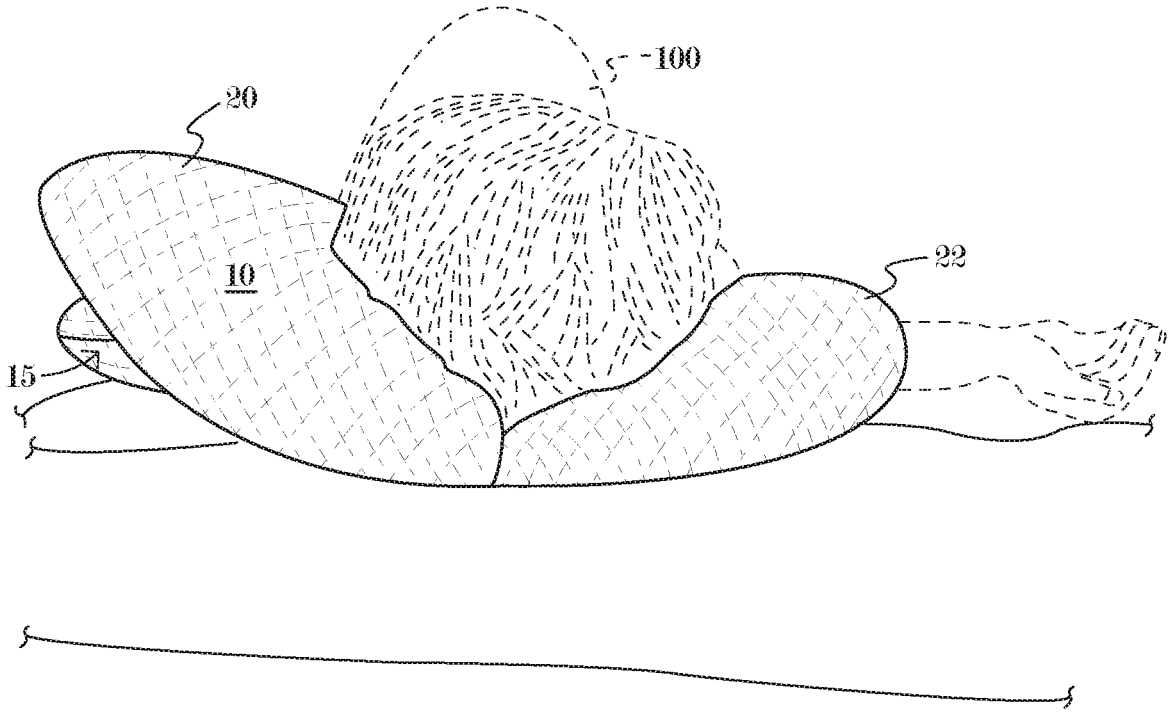
FIG. 10 is a back view of the exemplary embodiment of a multiple pod pillow system according to the present invention in use.
Figure 11:
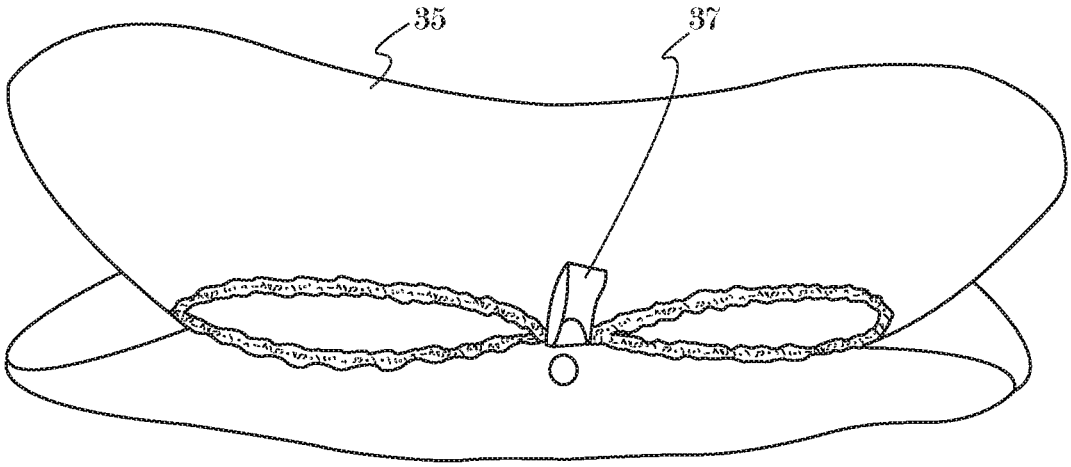
FIG. 11 is a back view of the exemplary embodiment of a multiple pod pillow system according to the present invention with an exemplary cover installed thereon.
Figure 12:
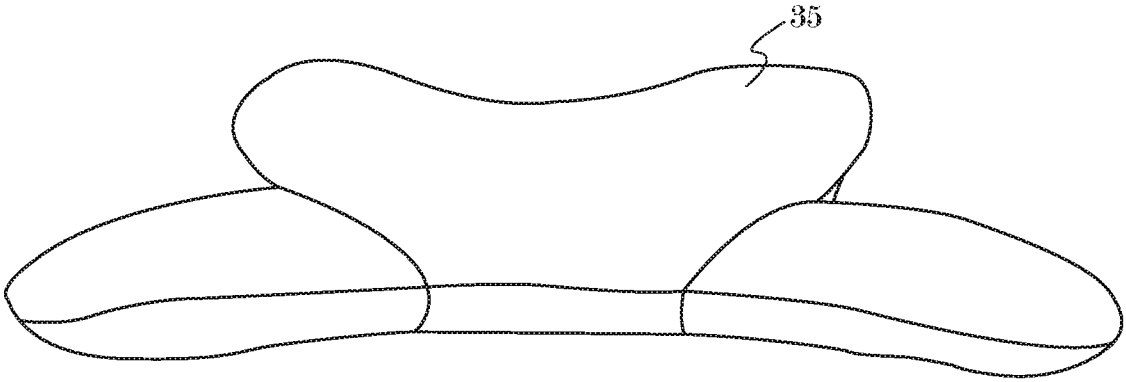
FIG. 12 is a front view of the exemplary embodiment of a multiple pod pillow system according to the present invention with the exemplary cover installed thereon.
Figure 13:
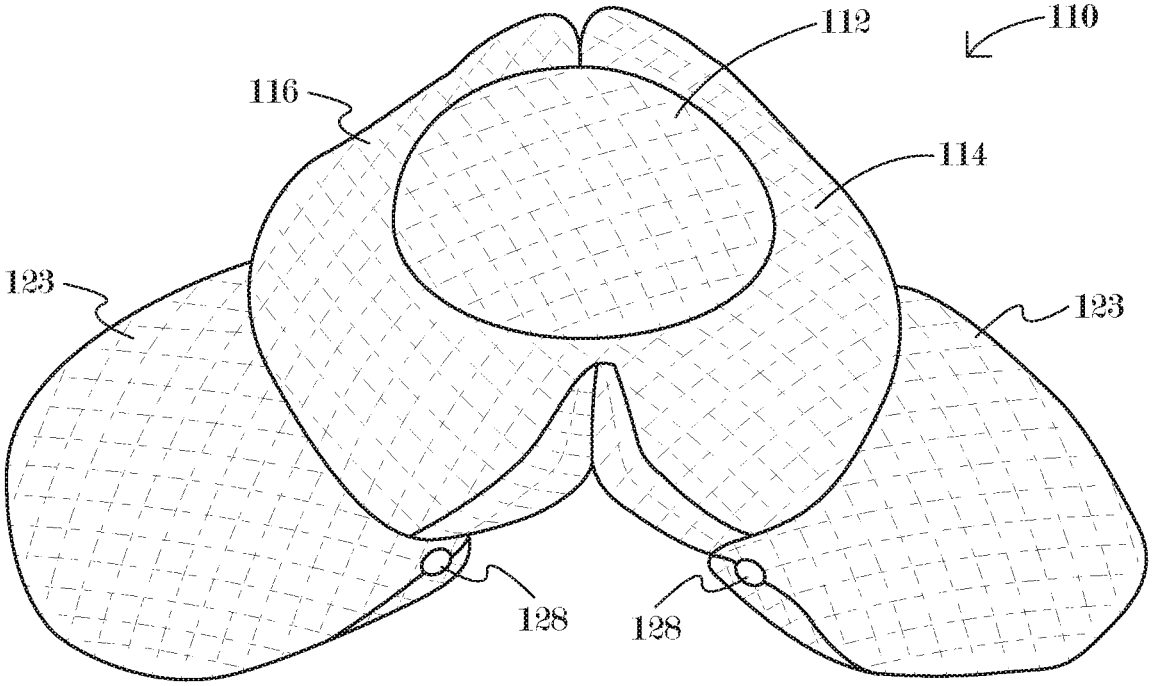
FIG. 13 is a top perspective view of an exemplary embodiment of a multiple pod pillow system according to the present invention with exemplary optional additional pods.
Figure 14:
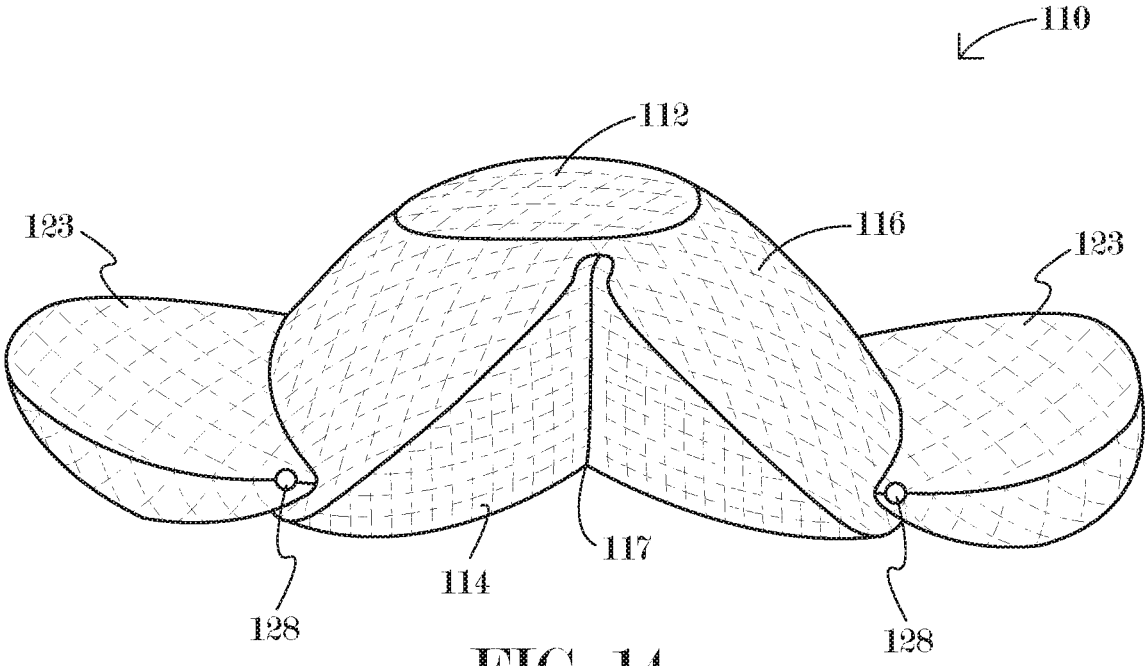
FIG. 14 is a rear perspective view of the exemplary embodiment of a multiple pod pillow system according to the present invention with exemplary optional additional pods.
Figure 15:
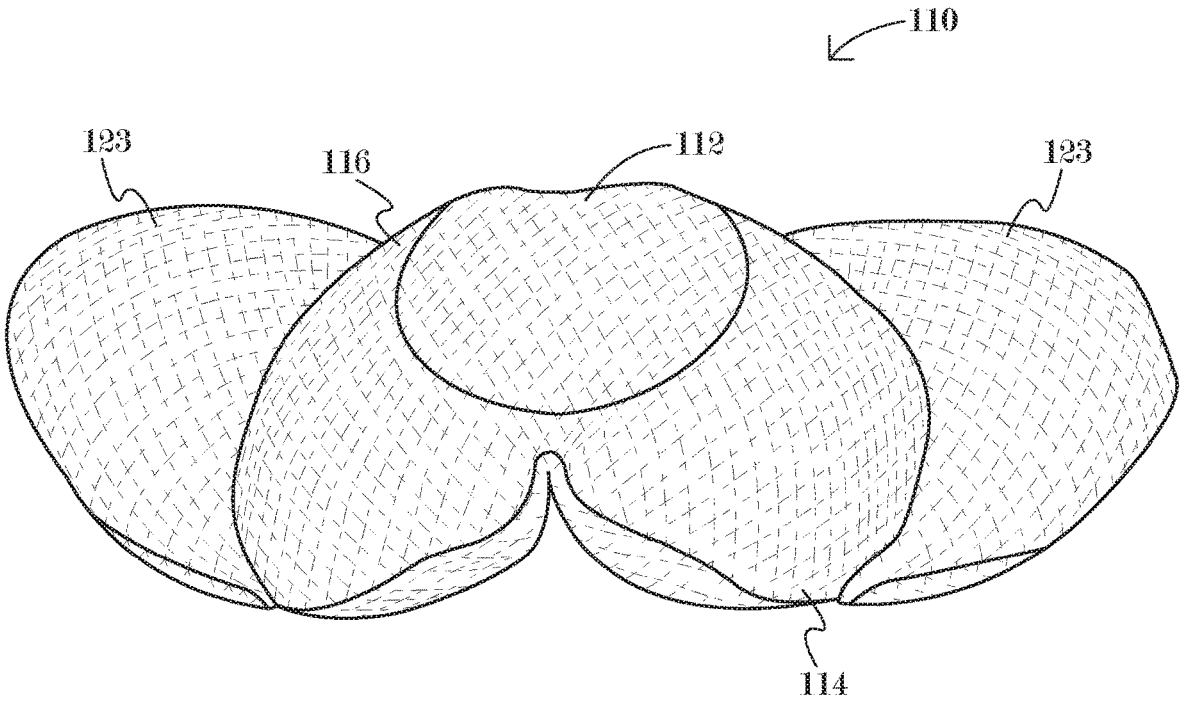
FIG. 15 is a top front perspective view of the exemplary embodiment of a multiple pod pillow system according to the present invention with exemplary optional additional pods.
Figure 16:
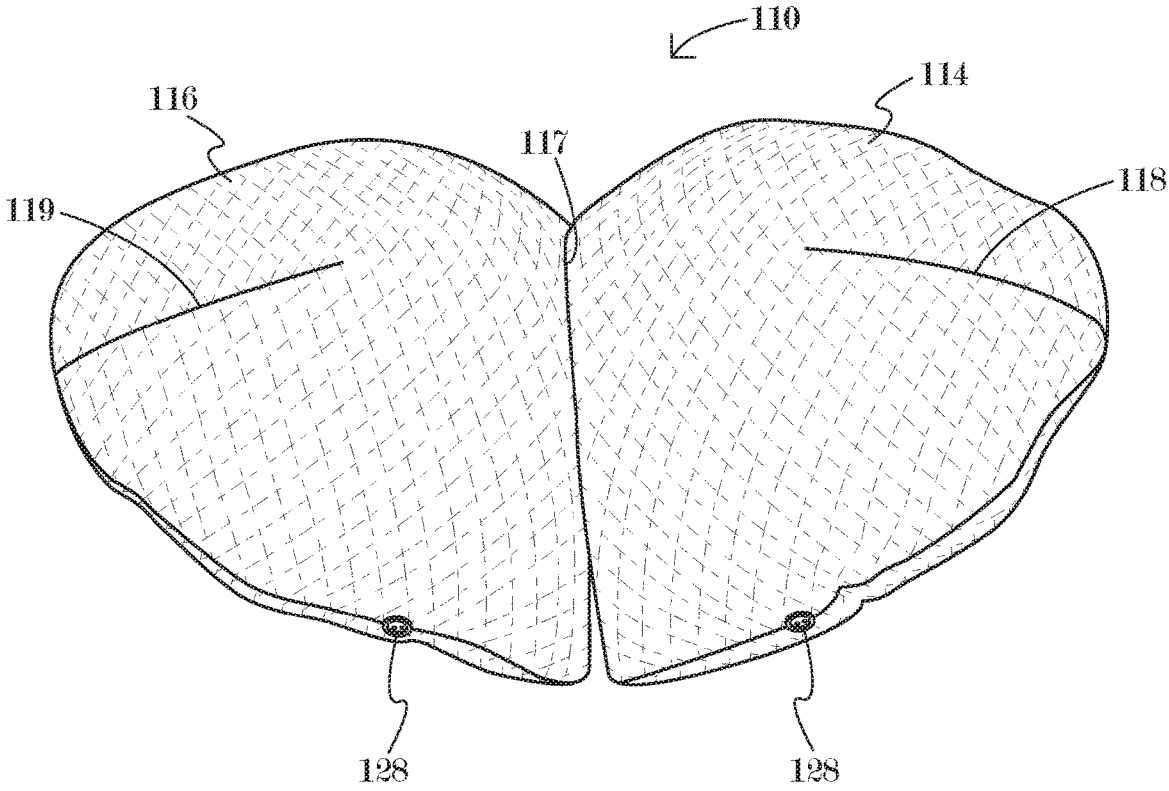
FIG. 16 is a bottom rear perspective view of the exemplary embodiment of a multiple pod pillow system according to the present invention.
Figure 17:
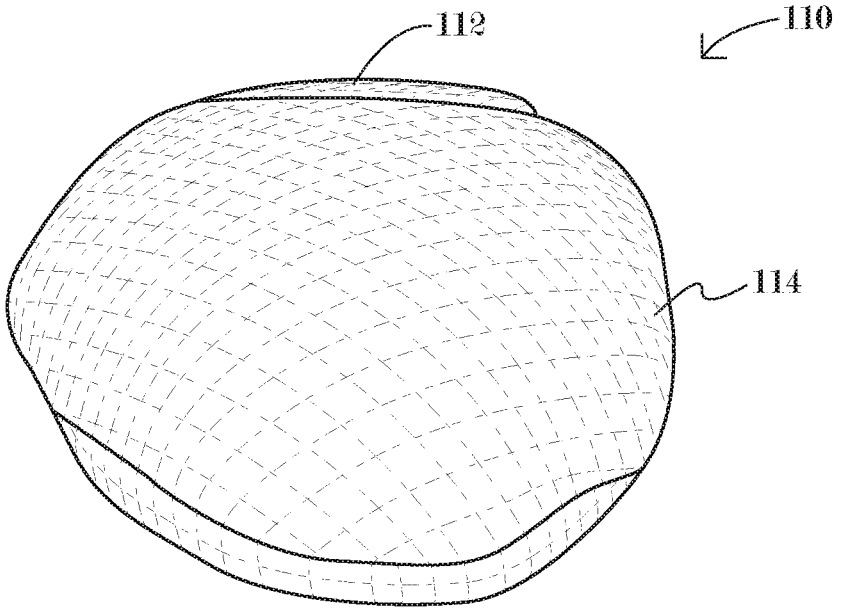
FIG. 17 is a left side view of the exemplary embodiment of a multiple pod pillow system according to the present invention.
Figure 18:
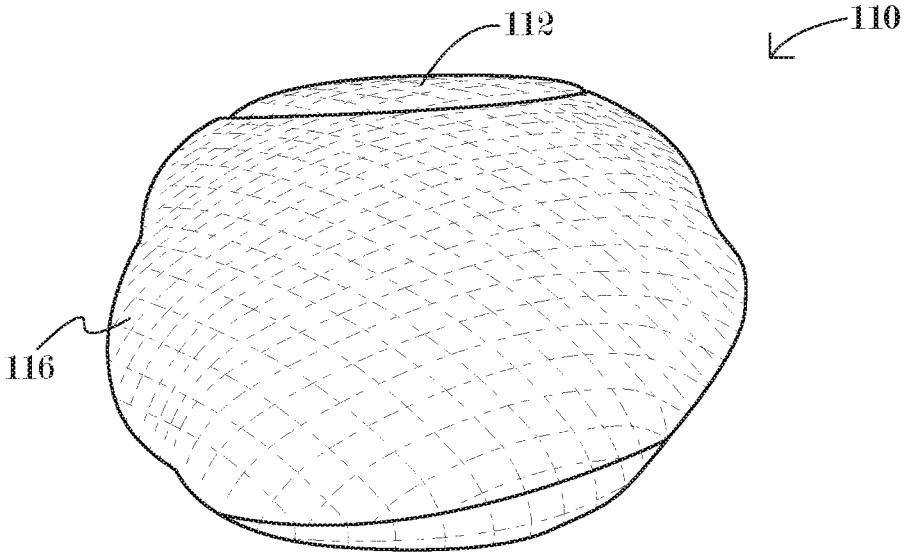
FIG. 18 is a right side view of the exemplary embodiment of a multiple pod pillow system according to the present invention.
Figure 19:
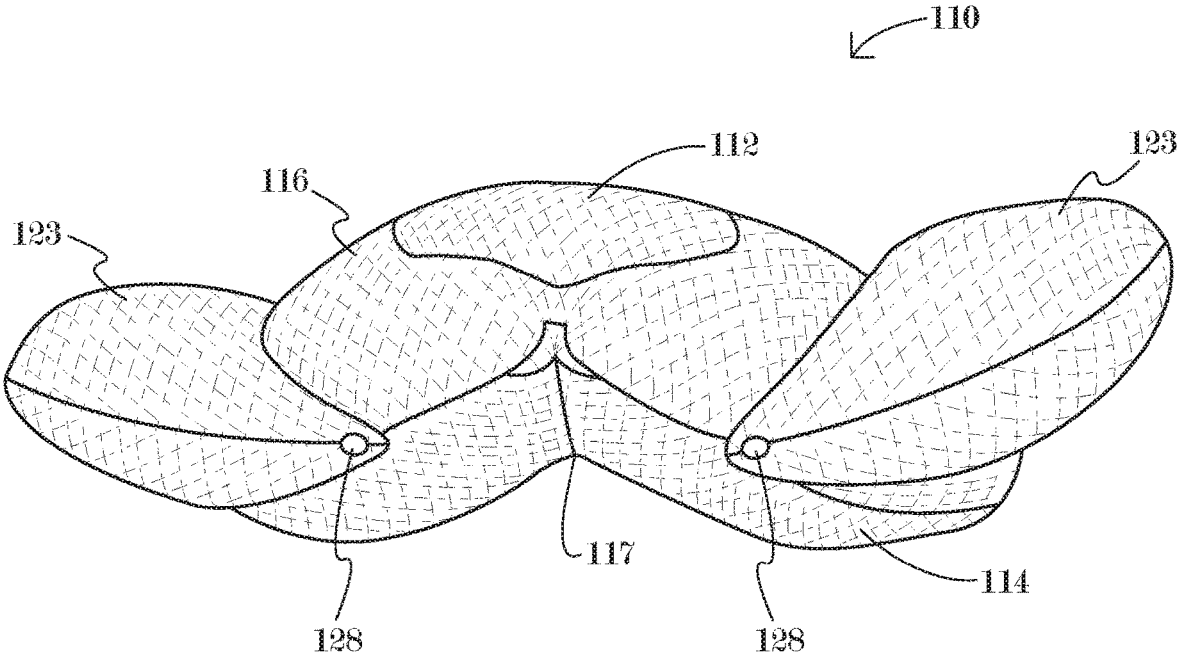
FIG. 19 is a top rear perspective view of the exemplary embodiment of a multiple pod pillow system according to the present invention with exemplary optional additional pods.
Figure 20:
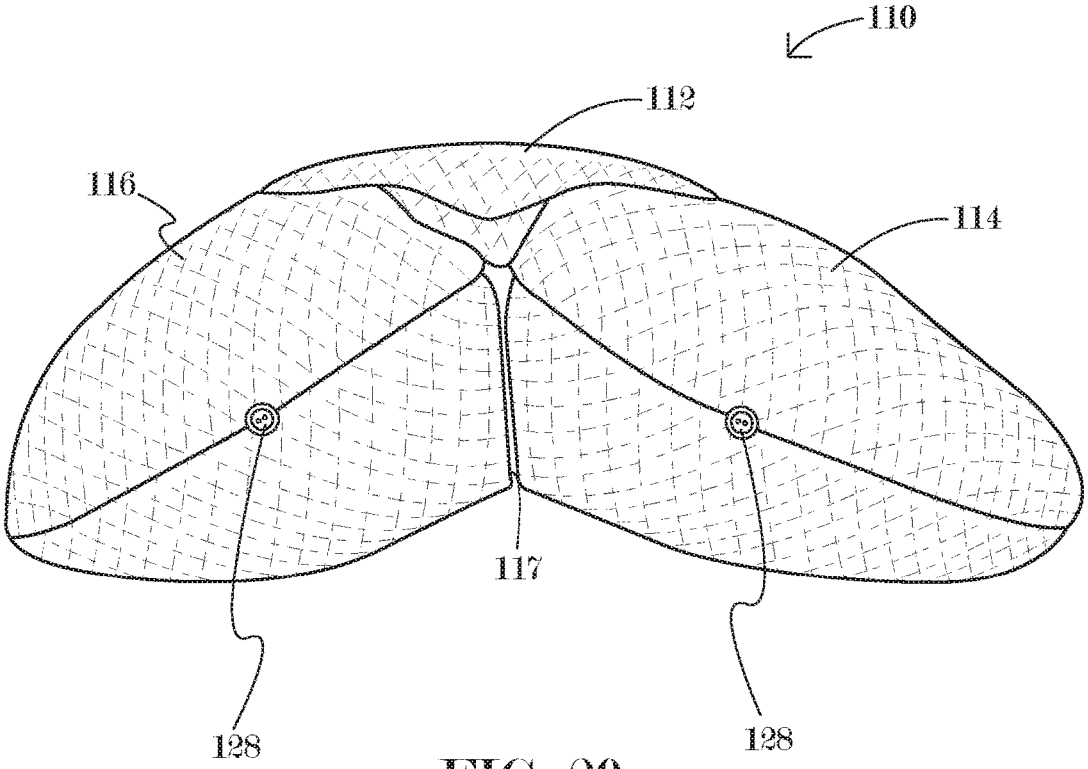
FIG. 20 is a rear elevational view of the exemplary embodiment of a multiple pod pillow system according to the present invention.
Figure 21:
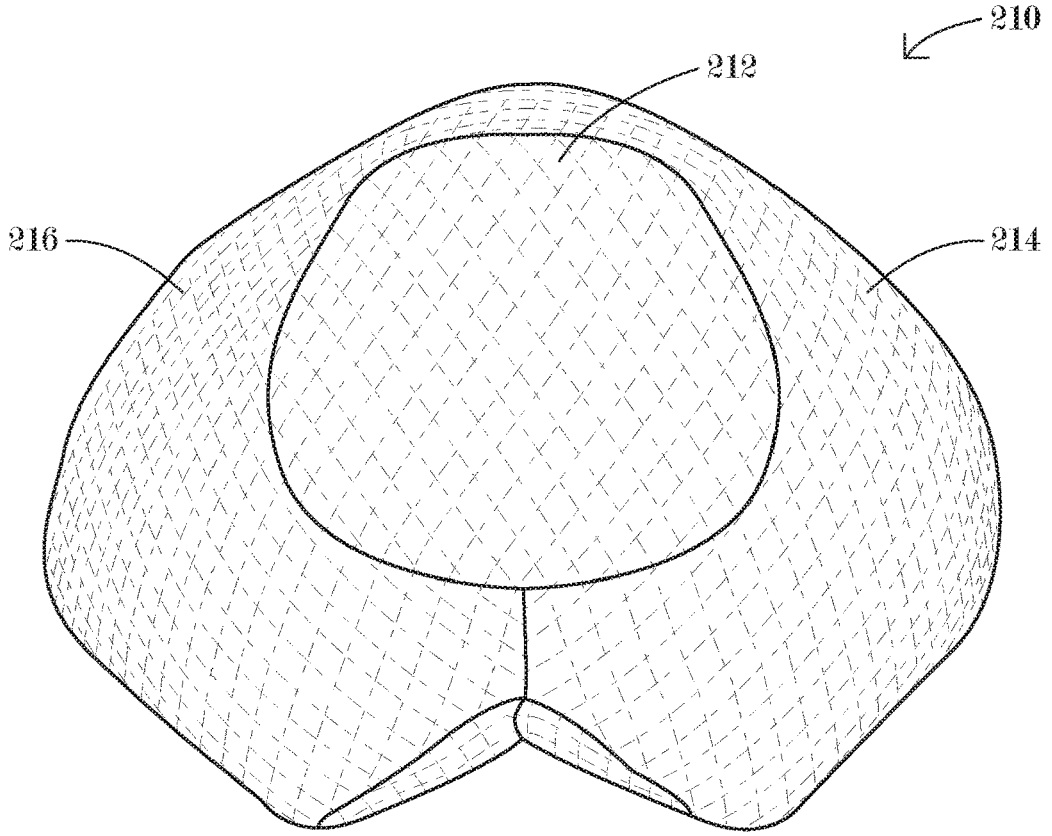
FIG. 21 is a top perspective view of an exemplary embodiment of a multiple pod pillow system according to the present invention.
Figure 22:
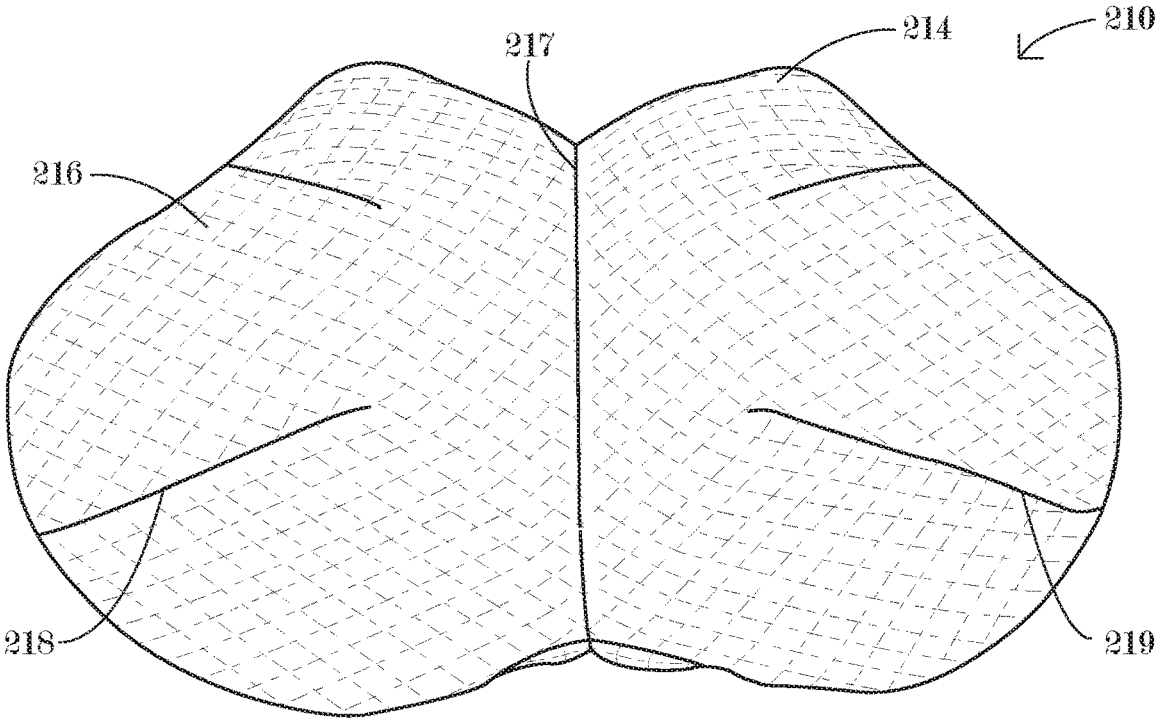
FIG. 22 is a bottom plan view of the exemplary embodiment of a multiple pod pillow system according to the present invention.

Referring now to FIG. 6, the pod pillow system 10 may also include an inner pod 30 that is positioned within the base pod 15. The inner pod 30 is self-contained, and therefore the filling of the inner pod 30 will not be dispersed within the interior region of the base pod 15. For example, the inner pod 30 is positioned within the central region of the base pod 15, and since the inner pod 30 is sealed from the interior region of the base pod 15, the filling of the inner pod 30 is inhibited and/or prevented from being disbursed away from the center of the base pod 15 towards the arms 27 of the base pod. This disbursement would typically happen as a result of continued use of the pod pillow system 10, if not for the self-contained configuration of the inner pod 30.

Referring now to FIGS. 1-6, each of the pods 15, 20, 22, 30 of the pod pillow system 10 may be filled with a filling material, and may be self-contained from the other pods so that the filling material is not transferred between the pods 15, 20, 22, 30. The self-containment of each of the pods 15, 20, 22, 30 allows for the filling material to not be displaced and either flatten or bulk up underneath the head of the user when the pod pillow system 10 is used. Preferably, each of the pods 15, 20, 22, 30 may be filled with an amount of filling material to provide a firm, but not too bulky appearance. The material used to construct the pods 15, 20, 22, 30 may preferably be hypoallergenic and moisture controlling fabric. Preferably the fabric may have characteristics that allow the fabric to maintain its structure but not be too rigid. The left top pod 20 and right top pod 22 may be made from a hypoallergenic and moisture controlling fabric, cotton and/or other pillow-appropriate fabrics.

Referring now to FIGS. 4-5 and 11-12, a form fitting cover 35 may be used in combination with the pod pillow system 10 in accordance with an exemplary embodiment of the present invention. The form fitting cover 35 may be constructed in a manner so that the form fitting cover 35 slips over the arms 27 of the base pod 15, and then snuggly fits over the left top pod 20 and right top pod 22, and may include an elastic to gather the fabric underneath the left top pod 20 and right top pod 22 so that the user may put his/her hands up the arm 27 of the pod pillow system 10 and under the left top pod 20 and/or right top pod 22 without obstructing the shape and form of the pod pillow system 10. The form fitting cover 35 may be pulled up and over the left top pod 20 and right top pod 22 and may be affixed to a tab 37, which may be constructed from grosgrain or the like, attached to the pod pillow system 10. The form fitting cover 35 may be affixed to the tab 37 by a snapping mechanism, hook and loop fasteners or the like. The tab 37 acts to secure the form fitting cover 35 to the pod pillow system 10 in order to prevent the form fitting cover 35 from slipping off the back of the pod pillow system 10 when the user is using the pod pillow system 10. The form fitting cover 35 may be made from cotton, polyester, a polyester blend or bamboo fabrics, or other such fabrics that may preferably be machine washable.

The exemplary manners in which the pod pillow system 10 may be used by a user 100 are shown in FIGS. 7-10, and it is understood that the manners shown are in no way limiting with respect to the uses of the present invention.

Referring now to FIGS. 13-20, therein illustrated is an exemplary embodiment of a multiple pillow pod system, generally indicated by reference numeral 110, according to the present invention. The multiple pillow pod system 110 according to this exemplary embodiment may include one or more individual pods, such as a central pod 112, a first flank pod 114 and a second flank pod 116. Each of the individual pods 112, 114, 116 may be self-contained from the other pods, so that the filling material inserted in each of the individual pods 112, 114, 116 does not transfer from one pod to another. In this manner, the pillow pod system 110 is configured to substantially maintain its shape and structure during use of the pillow pod system 110 by a user and even after repeated and/or prolonged use. The central pod 112 may be a separate pod that can be sewn inside of the multiple pod pillow system 110, or an encased pod within the multiple pod pillow system 110. The construction and positioning of the central pod 112 provides for additional support during compression of the middle portion of the multiple pod pillow system 110. The first flank pod 114 and the second flank pod 116 may be positioned at an angle relative to each other so that the pillow pod system 110 has a substantially V-shape or a substantially arcuate shape when the pillow pod system 110 is resting on a flat surface. Such configuration is shown best in FIGS. 19 and 20. The flank pods 114, 116 and construction of the underside of the pod pillow system 110 act to prevent and/or reduce the pod pillow system 110 from flattening out, and also permits the pod pillow system 110 to spring back into shape when not used. The weight of the head positioned on the central pod 112 causes the pod pillow system 110 to sink down slightly and tilt back slightly, while not causing the pod pillow system 110 to roll completely backwards. As the pod pillow system 110 slightly tips back under the weight of the user' head, the front of the pod pillow system 110 supports the natural lordotic curve of the user's neck by having enough thickness under and on both sides of the user. This allows the pod pillow system 110 to cradle the user's neck in a way that is comfortable and supportive while also preventing hyperextension, hyperflexion and extensive lateral bending. The overall feeling provided by the multiple pod pillow system 110 is that the head of a user is slightly suspended between the two flank pods 114, 116 to keep and maintain the desired neutral posture.

Referring again to FIGS. 13-20, the flank pods 114, 116 are attached together on a curve 117 with strategically placed darts 118, 119 on the underside of the pod pillow system 110, creating a well for the head of the user to slightly drop into so that the user's head is cradled without being stuck in the center area of the pod pillow system 110. This allows the head to remain in a stable, gravity-neutral position so the user's head neither hyperflexes nor hyper-extends. The arc of the curve 117 can be manipulated to control the height of the pod pillow system 110 relative to a surface on which the pod pillow system 110 is positioned. The height of the pod pillow system 110 enables the pod pillow system 110 to accommodate different-sized users. The back section of the curve 117 and the front section of the curve 117 are flanked by straight pieces that accommodate the slight tilt to the back of the pod pillow system 110 while not compromising the support of the neck of a user. The straight piece flanking the front part of the curve 117 allows the neck to remain neutral, while the straight piece flanking the back of the curve prevents the pod pillow system 110 from rocking back and forth when in use.

Figure 29:
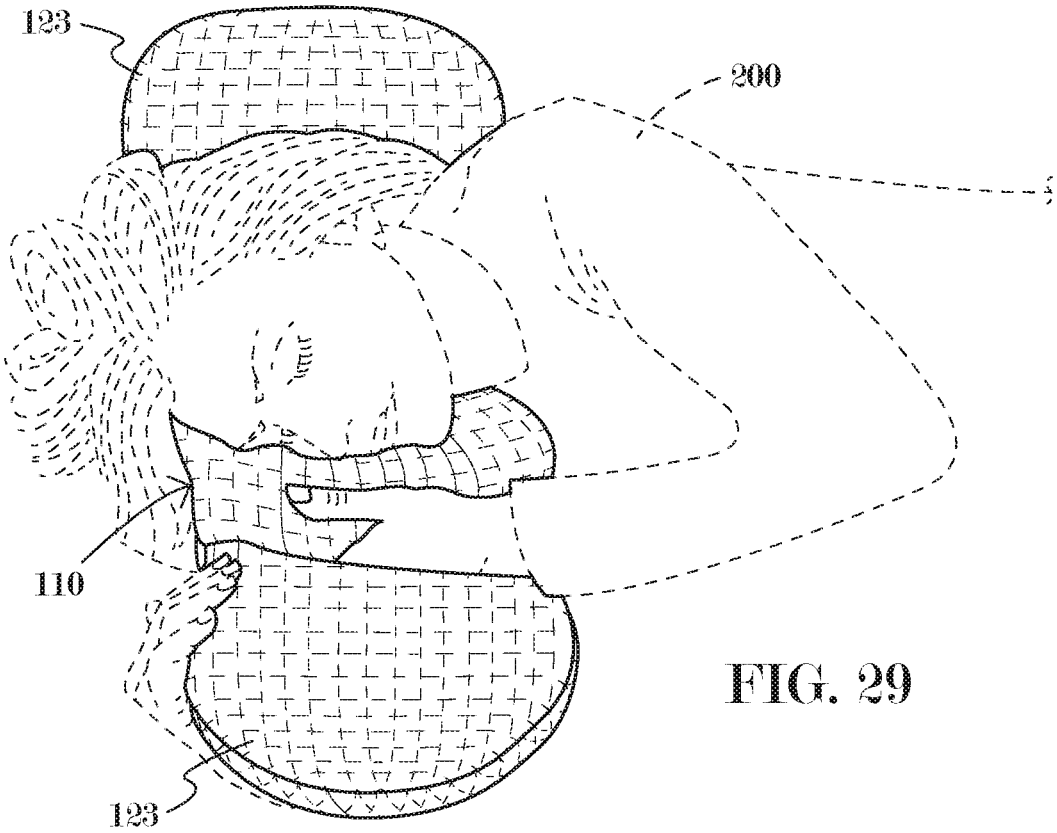
FIG. 29 is a right side perspective view of the exemplary embodiment of a multiple pod pillow system with exemplary optional additional pods in use.
Figure 30:
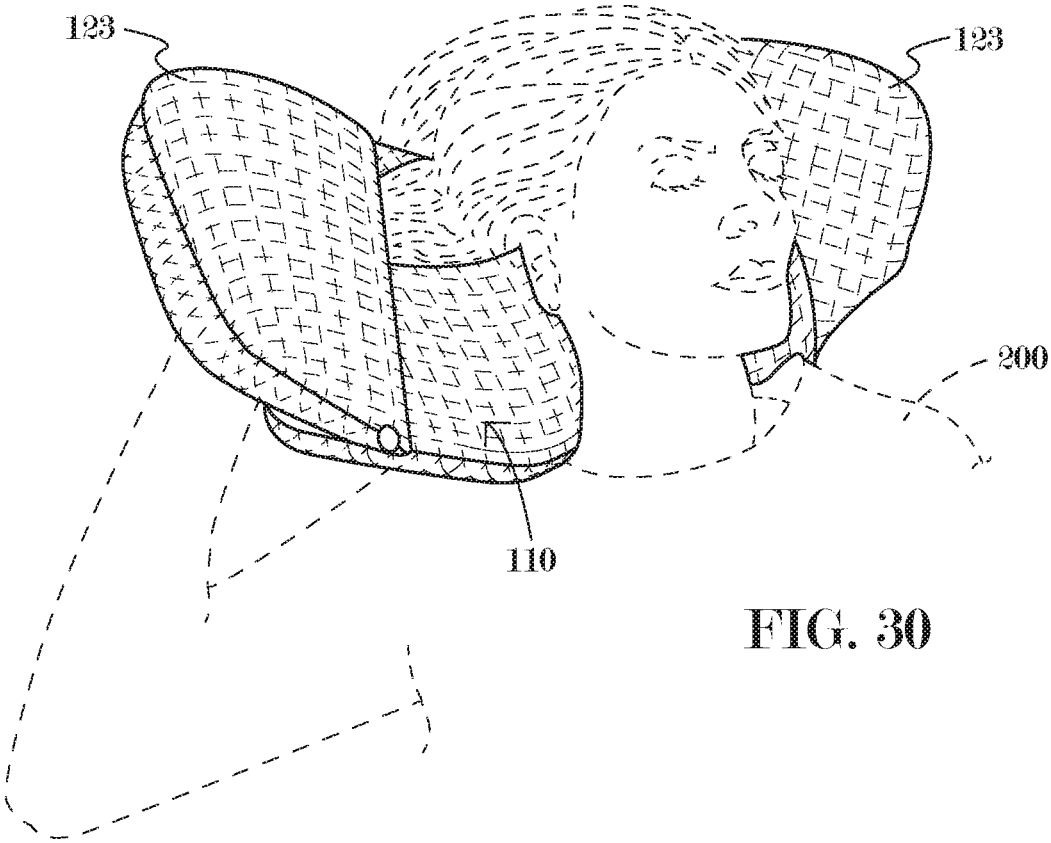
FIG. 30 is a front perspective view of the exemplary embodiment of a multiple pod pillow system with exemplary optional additional pods in use.

Referring now specifically to FIGS. 13-16, 19-20 and 27-28, the pod pillow system 110 may also include one or more additional pod extensions 123 that can be removably attached to the pod pillow system 110 by one or more attachment devices 128. The attachment devices 128 may be any suitable removably fastener mechanism, such as snaps, buttons, hook-and-loop fasteners or the like. Alternatively, the attachment devices 128 may be configured to allow for permanent affixation of the pod extensions 123 to the pod pillow system 110, and it is understood that the present invention is not limited to whether the pod extensions 123 are removable or permanently affixed to the pod pillow system 110. The pod extensions 123 help to accommodate users who prefer to have something to hold onto while the user sleeps, for example as shown by the exemplary user 200 in FIGS. 29-30. The pod extensions 123 can function to both create a pocket between the pod pillow system 110 and the pod extension 123 for the user 200 to insert their hand into, or provide a structure on which the user 200 can hold while sleeping. The pod pillow system 110 can be used a regular pillow for sleeping or as a travel pillow.

The pod pillow system 110 may also include a form-fitting cover (not shown) that is configured to substantially cover the pod pillow system 110, and/or any additional pod extensions 123 that may be affixed to the pod pillow system 110. The form-fitting cover (not shown) may include one or more hand straps (not shown) to help accommodate users who prefer having pillow arms to hold onto during sleep. Alternatively or additionally, the pod pillow system 110 itself may include one or more hand straps (not shown) affixed to the outer cover of the pod pillow system 110.

Referring now to FIGS. 21-26, therein illustrated is an exemplary embodiment of a multiple pillow pod system, generally indicated by reference numeral 210, according to the present invention. The multiple pillow pod system 210 according to this exemplary embodiment may include one or more individual pods, such as a central pod 212, a first flank pod 214 and a second flank pod 216. Each of the individual pods 212, 214, 216 may be self-contained from the other pods, so that the filling material inserted in each of the individual pods 212, 214, 216 does not transfer from one pod to another. In this manner, the pillow pod system 210 is configured to substantially maintain its shape and structure during use of the pillow pod system 210 by a user and even after repeated and/or prolonged use. The central pod 212 may be a separate pod that can be sewn inside of the multiple pod pillow system 210, or an encased pod within the multiple pod pillow system 210. The construction and positioning of the central pod 212 provides for additional support during compression of the middle portion of the multiple pod pillow system 210. The first flank pod 214 and the second flank pod 216 may be positioned at an angle relative to each other so that the pillow pod system 210 has a substantially V-shape or a substantially arcuate shape when the pillow pod system 210 is resting on a flat surface. Such configuration is shown best in FIGS. 25 and 26. The flank pods 214, 216 and construction of the underside of the pod pillow system 210 act to prevent and/or reduce the pod pillow system 210 from flattening out, and also permits the pod pillow system 210 to spring back into shape when not used. The weight of the head positioned on the central pod 212 causes the pod pillow system 210 to sink down slightly and tilt back slightly, while not causing the pod pillow system 210 to roll completely backwards. As the pod pillow system 210 slightly tips back under the weight of the user' head, the front of the pod pillow system 210 supports the natural lordotic curve of the user's neck by having enough thickness under and on both sides of the user. This allows the pod pillow system 210 to cradle the user's neck in a way that is comfortable and supportive while also preventing hyper-extension, hyperflexion and extensive lateral bending. The overall feeling provided by the multiple pod pillow system 210 is that the head of a user is slightly suspended between the two flank pods 214, 216 to keep and maintain the desired neutral posture.

Referring again to FIGS. 13-20, the flank pods 214, 216 are attached together on a curve 217 with strategically placed darts 218, 219 on the underside of the pod pillow system 210, creating a well for the head of the user to slightly drop into so that the user's head is cradled without being stuck in the center area of the pod pillow system 210. This allows the head to remain in a stable, gravity-neutral position so the user's head neither hyperflexes nor hyper-extends. The arc of the curve 217 can be manipulated to control the height of the pod pillow system 210 relative to a surface on which the pod pillow system 210 is positioned. The height of the pod pillow system 210 enables the pod pillow system 210 to accommodate different-sized users. The back section of the curve 217 and the front section of the curve 217 are flanked by straight pieces that accommodate the slight tilt to the back of the pod pillow system 210 while not compromising the support of the neck of a user. The straight piece flanking the front part of the curve 217 allows the neck to remain neutral, while the straight piece flanking the back of the curve prevents the pod pillow system 210 from rocking back and forth when in use.

Figure 23:
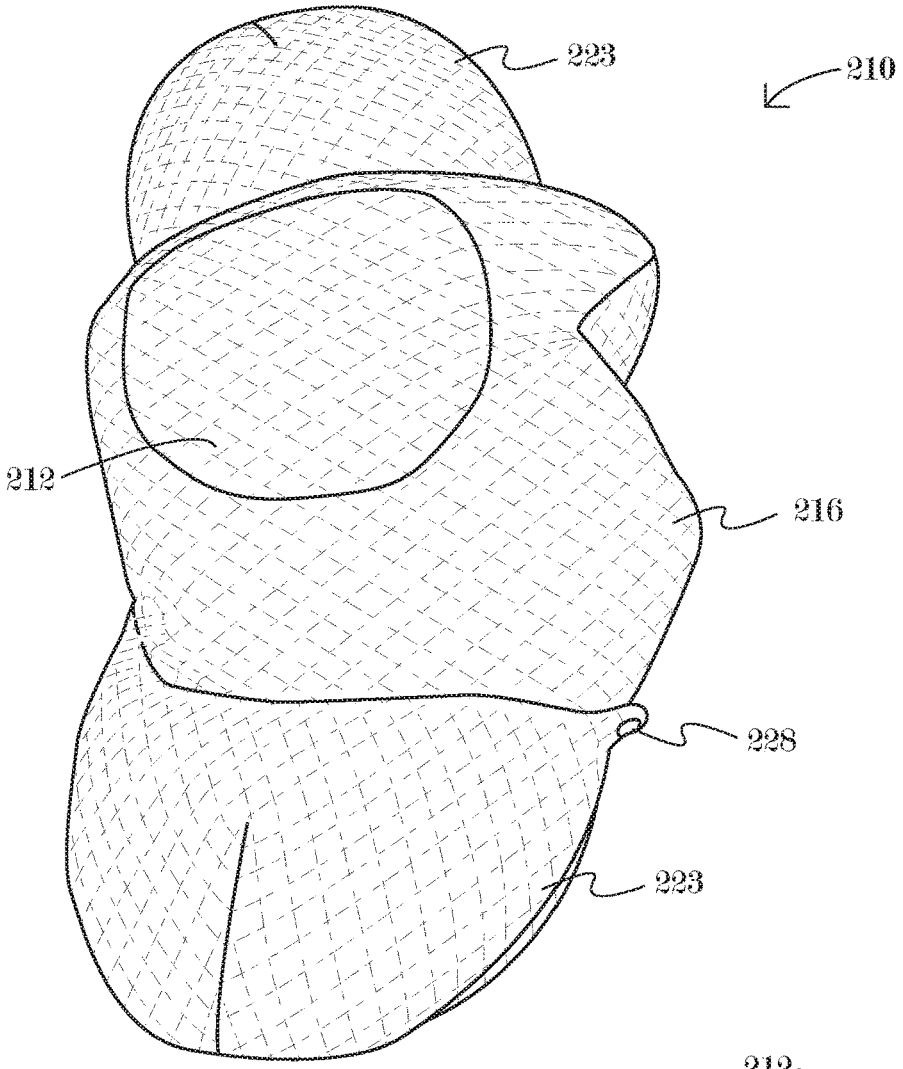
FIG. 23 is a right side perspective view of the exemplary embodiment of a multiple pod pillow system according to the present invention with exemplary optional additional pods.
Figure 24:
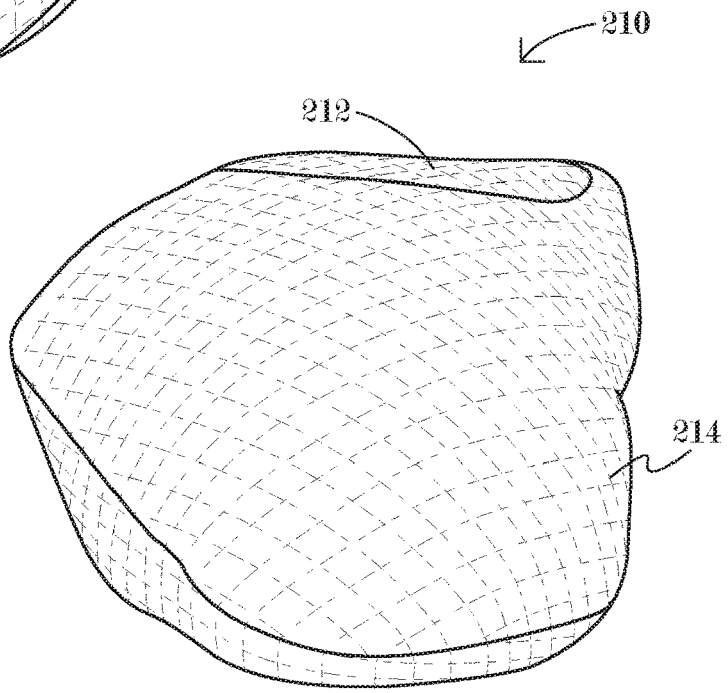
FIG. 24 is a left side elevational view of the exemplary embodiment of a multiple pod pillow system according to the present invention.
Figure 25:
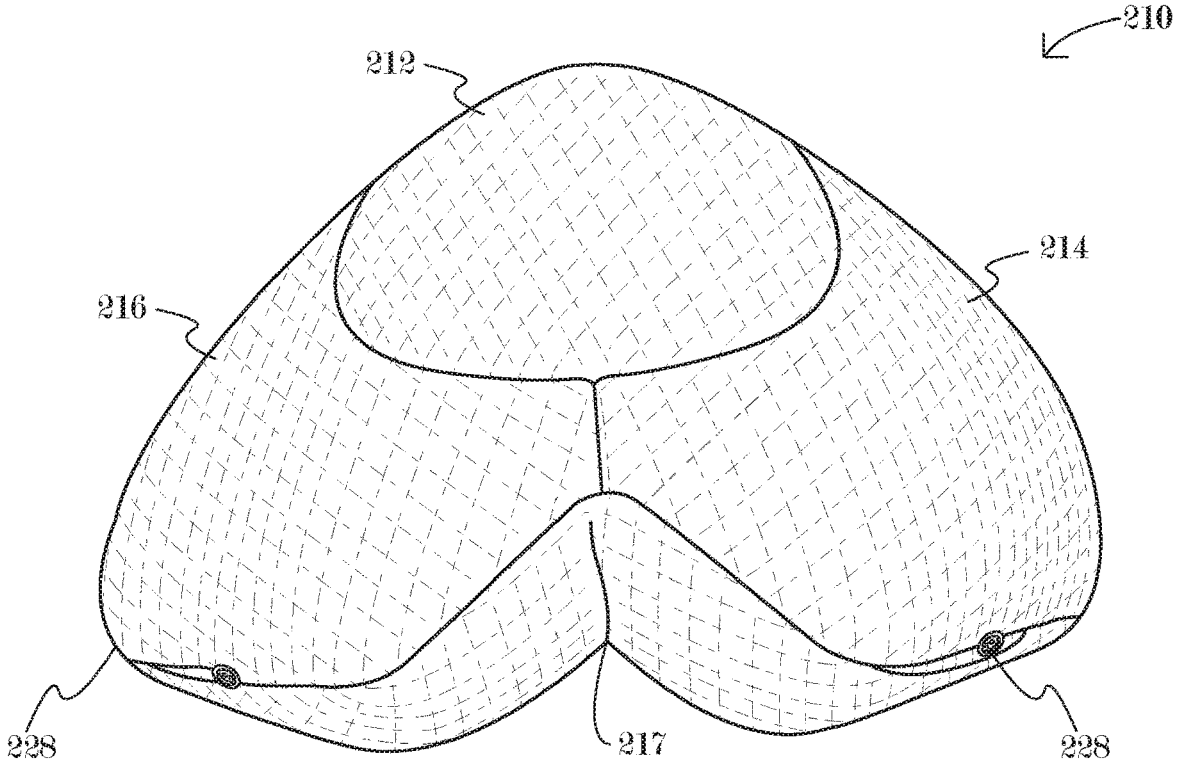
FIG. 25 is a front perspective view of the exemplary embodiment of a multiple pod pillow system according to the present invention.
Figure 26:
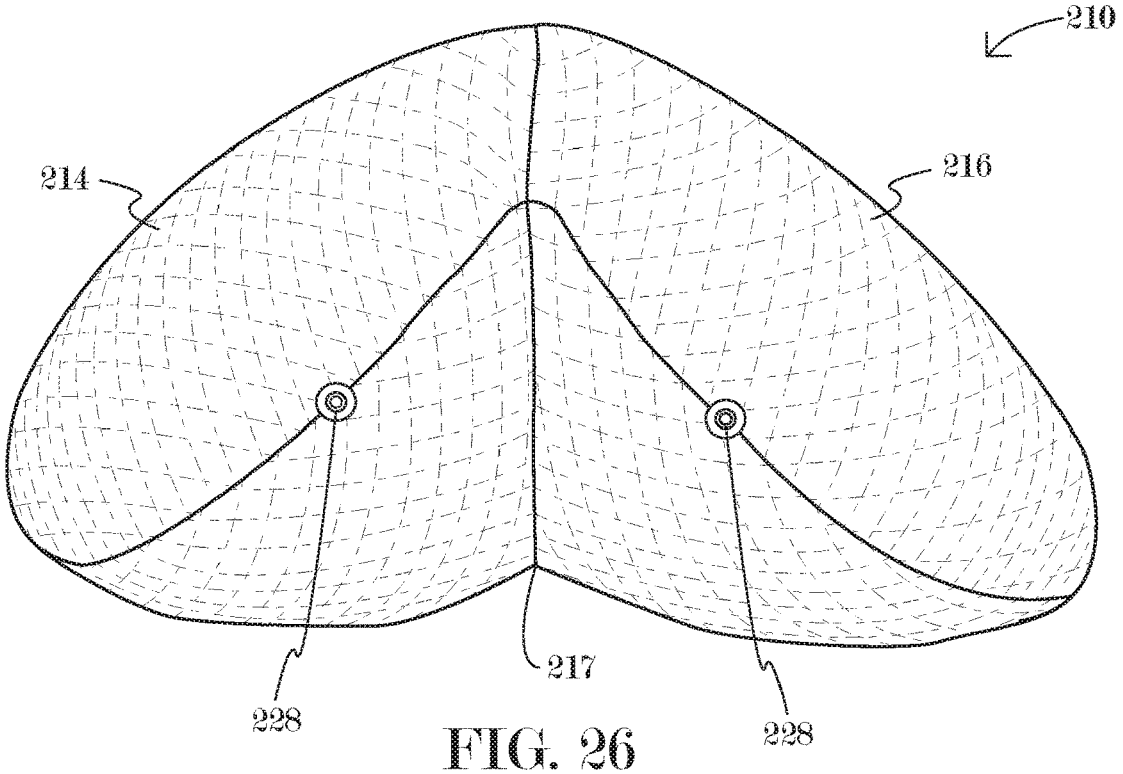
FIG. 26 is a rear elevational view of the exemplary embodiment of a multiple pod pillow system according to the present invention.
Figure 27:
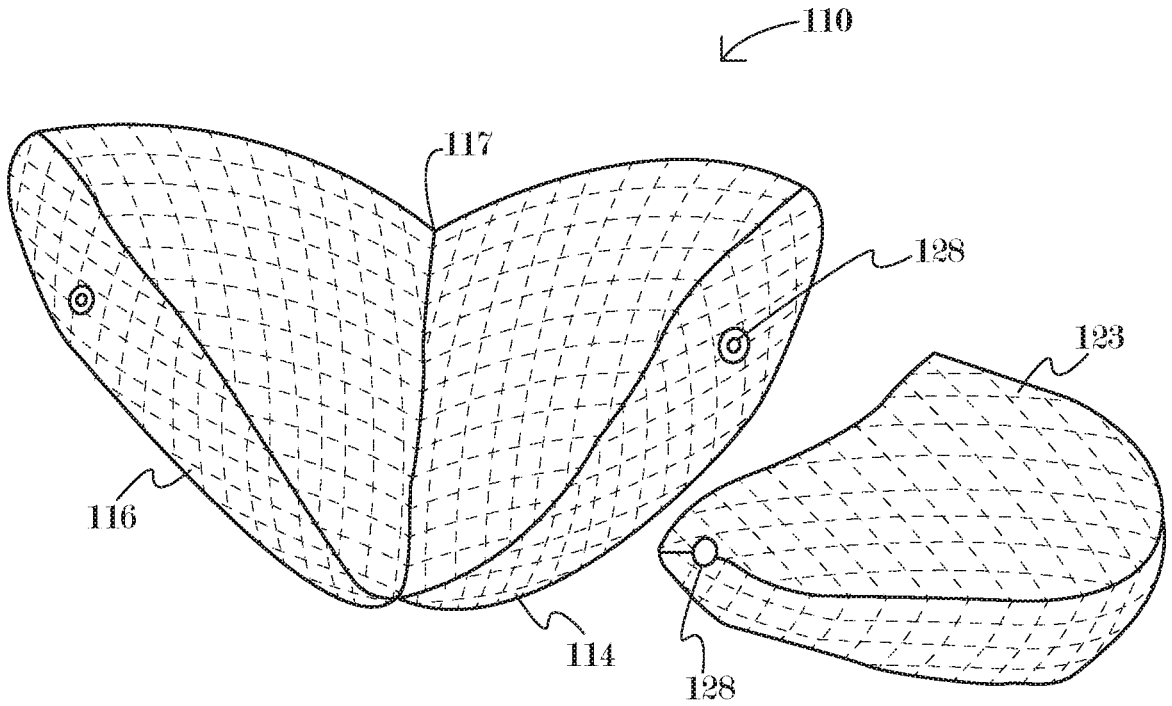
FIG. 27 is a rear inverted view of the exemplary embodiment of a multiple pod pillow system according to the present invention with an exemplary optional additional pod detached from the multiple pod pillow system.
Figure 28:
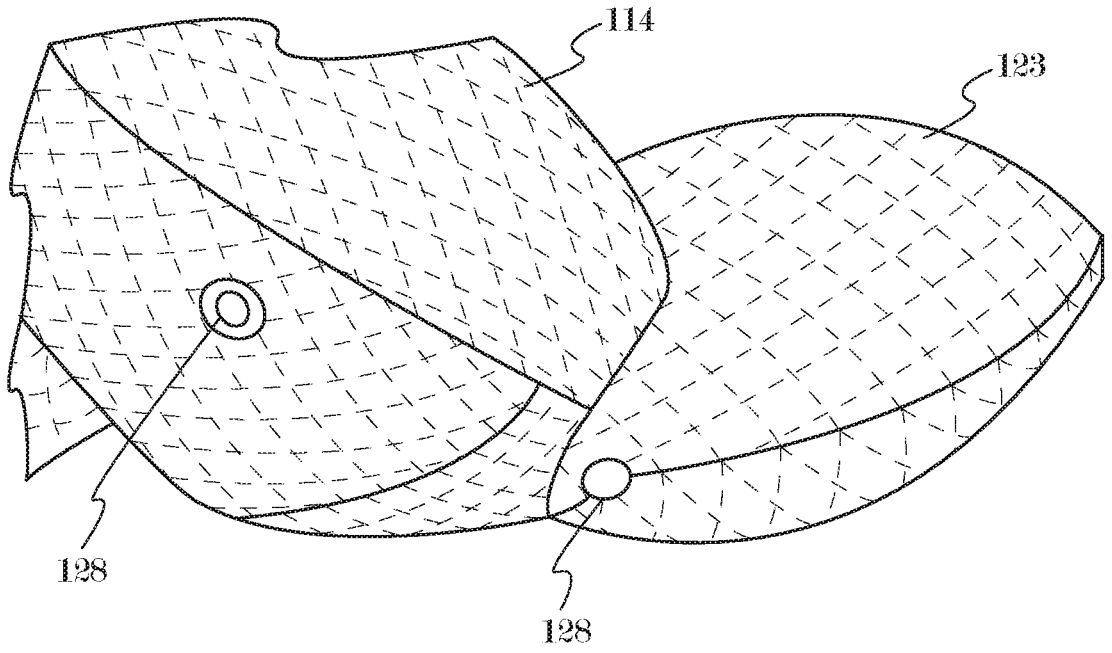
FIG. 28 is an expanded view of the joint between the multiple pod pillow system from FIG. 27, and the optional additional pod.

Referring now specifically to FIG. 23, the pod pillow system 210 may also include one or more additional pod extensions 223 that can be removably attached to the pod pillow system 210 by one or more attachment devices 228. The attachment devices 228 may be any suitable removably fastener mechanism, such as snaps, buttons, hook-and-loop fasteners or the like. Alternatively, the attachment devices 228 may be configured to allow for permanent affixation of the pod extensions 223 to the pod pillow system 210, and it is understood that the present invention is not limited to whether the pod extensions 223 are removable or permanently affixed to the pod pillow system 210. The pod extensions 223 help to accommodate users who prefer to have something to hold onto while the user sleeps. The pod extensions 223 can function to both create a pocket between the pod pillow system 210 and the pod extension 223. The pod pillow system 210 can be used a regular pillow for sleeping or as a travel pillow.

The pod pillow system 210 may also include a form-fitting cover (not shown) that is configured to substantially cover the pod pillow system 210, and/or any additional pod extensions 223 that may be affixed to the pod pillow system 210. The form-fitting cover (not shown) may include one or more hand straps (not shown) to help accommodate users who prefer having pillow arms to hold onto during sleep.

Alternatively or additionally, the pod pillow system 210 itself may include one or more hand straps (not shown) affixed to the outer cover of the pod pillow system 210.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A pod pillow system, comprising:

a central pod having a first interior region;

a first pod positioned adjacent to the central pod and having a second interior region;

a second pod having a third interior region, being positioned adjacent to the central pod and connected relative to the first pod to form a substantially V-shaped configuration on the side of the pod pillow system that is opposite the central pod;

wherein the positioning of the first pod relative to the second pod forms a first notch adjacent to the central pod between the first pod and the second pod, and a second notch opposite the first notch between the first pod and the second pod;

wherein an arcuate curve extends around the side of the pod pillow system opposite the central pod between the first notch and the second notch, and the curve is positioned at the base of the V-shaped configuration formed by the connection of the first pod and the second pod; and wherein the central pod, the first pod and the second pod are configured for receipt of a fill material, and the fill material received within each of the central pod, first pod and second pod is retained within the respective pod.

2. The pod pillow system according to claim 1, wherein the first pod and the second pod are each attached to the central pod at a central location of the pod pillow system.

3. The pod pillow system according to claim 1, wherein the first pod and the second pod increase in size outward from the connection between the first pod and the second pod.

4. The pod pillow system according to claim 1, wherein the central pod, the first pod and the second pod are connected so that their respective interior regions are independent of each other.

5. The pod pillow system according to claim 1, further comprising at least one extension pod removably affixed to pod pillow system.

6. The pod pillow system according to claim 5, wherein one of the at least one extension pod is removably affixed to the first pod by an attachment mechanism.

7. The pod pillow system according to claim 6, wherein a cavity is formed between the extension pod and the first pod.

8. The pod pillow system according to claim 1, wherein the central pod comprises one or more arm extensions.

* * * * *